US006739226B2

(12) United States Patent
Beauchamp

(10) Patent No.: US 6,739,226 B2
(45) **Date of Patent: *May 25, 2004**

(54) STATIONARY BIT HOLDER

(76) Inventor: Fern Beauchamp, 13 Clayburn Avenue, St. Catharines, Ontario (CA), L2P 2S3

( * ) Notice: Subject to any disclaimer, the term of this patent is extended or adjusted under 35 U.S.C. 154(b) by 81 days.

This patent is subject to a terminal disclaimer.

(21) Appl. No.: 10/029,922

(22) Filed: Dec. 31, 2001

(65) Prior Publication Data

US 2003/0079580 A1 May 1, 2003

Related U.S. Application Data

(63) Continuation-in-part of application No. 09/983,567, filed on Oct. 25, 2001.

(51) Int. Cl.[7] ..... B25G 1/08
(52) U.S. Cl. ..... 81/490; 81/177.4
(58) Field of Search ..... 81/177.4, 438, 81/439, 490

(56) References Cited

U.S. PATENT DOCUMENTS

| | | | | | |
|---|---|---|---|---|---|
| 2,667,194 | A | * | 1/1954 | Fischer et al. | 81/438 |
| 2,833,548 | A | * | 5/1958 | Clark | 81/438 |
| 2,838,082 | A | * | 6/1958 | Lange | 81/438 |
| 4,514,117 | A | | 4/1985 | Scott | |
| 4,893,529 | A | * | 1/1990 | Lin | 81/439 |
| 5,063,796 | A | * | 11/1991 | Gennep | 81/177.4 |
| 5,740,706 | A | * | 4/1998 | Tseng | 81/490 |
| 5,884,541 | A | * | 3/1999 | Habermehl et al. | 81/438 |
| 5,921,562 | A | | 7/1999 | Robison | |
| 6,053,675 | A | | 4/2000 | Holland | |
| RE36,797 | E | * | 8/2000 | Eggert et al. | 81/438 |
| 6,163,911 | A | | 12/2000 | Lin | |
| 6,199,872 | B1 | * | 3/2001 | Hasan | 81/438 |
| 6,237,451 | B1 | | 5/2001 | Wel | |
| 6,243,902 | B1 | * | 6/2001 | Huang | 81/490 |
| 6,293,173 | B1 | | 9/2001 | Rowlay | |
| 6,305,255 | B1 | | 10/2001 | Wu | |
| 6,332,384 | B1 | * | 12/2001 | Cluthe | 81/490 |
| 2002/0007705 | A1 | * | 1/2002 | Beauchamp | 81/409 |

* cited by examiner

*Primary Examiner*—James G. Smith

(57) ABSTRACT

The present invention a stationary bit holder comprises a drill attachment for use with a drill chuck includes a shaft adapted at one end for releasably mounting to the drill chuck, and at the other end for releasably mounting tool bits therein; and, a housing connected operably to said shaft, said housing defining bit compartments for releasably receiving tool bits therein. The bit holder further includes actuator assemblies and actuator channels corresponding to each bit compartment, wherein said actuator assembly being slidably received along each actuator channel and bit compartment, wherein said actuator assembly for slidably urging said tool bit longitudinally along said bit compartment. The devices preferably wherein said shaft means rotates in unison with said drill chuck and said storing means is slidably received on said shaft means thereby rotating independently on said shaft means such that said storing means can be held stationary as said shaft means rotates.

6 Claims, 30 Drawing Sheets

100
110
111
112
114
116
118
126
130
144

124
122
130
152
112
118
116
140
126
110
150
114
120
144
111
180

FIG. - 16
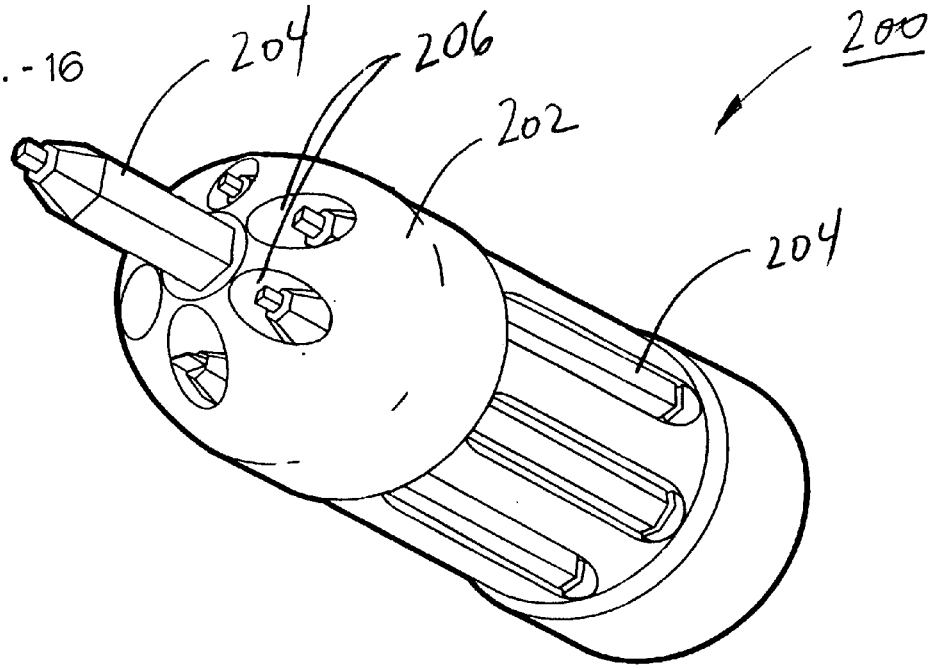
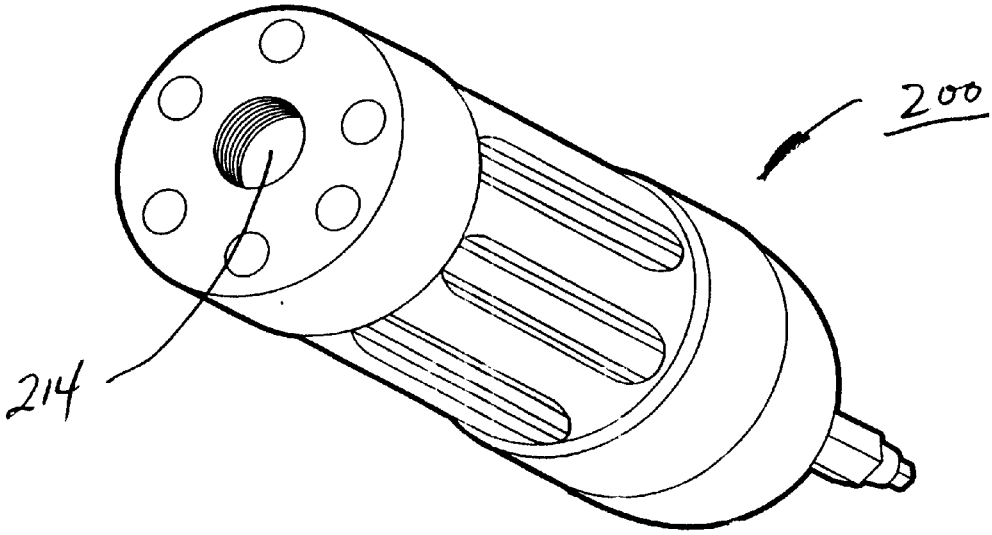
FIG. - 17

230
232
230
208
208

240

242
244
200
242

242

250

200

244

244

STATIONARY BIT HOLDER

CROSS REFERENCE TO RELATED APPLICATION

This application is a continuation in part of our earlier application filed under Ser. No. 09/983,567 on Oct. 25, 2001 under the title BIT HOLDER still pending.

FIELD OF THE INVENTION

The present invention relates generally to power tools and more particularly to a bit holder adapted to be received in a drill chuck.

BACKGROUND OF THE INVENTION

A number of devices are available on the market for releasably holding and storing tools bits in various containers. The major draw back with the existing devices is that each time a tool bit is selected to be inserted into a drill chuck for example, the chuck must be released and the tool bit must be inserted. There are adapters on the market presently which allow for magnetically receiving and releasing tools bits once such an adapter is placed in a chuck of a drill bit. The draw back of these devices is that the tool bits are held separately from the adapter.

Therefore, it is desirable to have a device which combines both the adapter and the tool bit holding container, such that tool bits are readily available any time and in close proximity to the drill chuck and are similar to existing adapters on the market magnetically received in an adapter for easy insertion and removal.

SUMMARY OF THE INVENTION

The present invention a bit holder for use with a drill chuck comprises:

(a) a shaft means adapted at one end for releasably mounting to the drill chuck, and at the other end for releasably mounting tool bits therein; and, (b) a means for releasably storing tool bits in nested fashion around said shaft such that said shaft means and said storing means rotate in unison with said drill chuck.

Preferably wherein said storing means comprises a framework rigidly attached to said shaft means, said framework defining bit compartments for releasably receiving tool bits therein.

Preferably wherein said framework further includes at least two dividers extending radially from said shaft wherein said dividers define side walls of said bit compartments.

Preferably wherein said framework further includes a circular base and cylindrical retainer wherein said retainer base and dividers define the space of each bit compartment.

Preferably wherein said retainer further includes a means for holding said tool bits within each bit compartment and also for selectively releasing a tool bit.

Preferably wherein said hold meanings includes a retainer opening operable to be positioned for selectively releasing a tool bit.

Preferably wherein said retainer rotates about said base for selectively positioning said opening to release a tool bit.

In an alternate embodiment the invention is a bit holder for use with a handle and comprises:

(a) a shaft means adapted at one end for mounting to the handle, and at the other end for releasably mounting tool bits therein; and, (b) a means for releasably storing tool bits in nested fashion around said shaft such that said shaft means and said storing means rotate in unison with said handle.

In a presently preferred embodiment the present invention a bit holder for use with a drill chuck comprises:

(a) a shaft means including at one end means for releasably mounting to the drill chuck, and at the other end a chuck means for releasably mounting tool bits therein; and, (b) a means for releasably storing tool bits in bit compartments located in nested fashion around said shaft.

Preferably wherein said storing means comprises a housing connected operably to said shaft means, said housing defining bit compartments for releasably receiving tool bits therein.

Preferably wherein said bit holder means further includes a means for retaining said tool bits within each bit compartment and also for selectively releasing a tool bit.

Preferably wherein said retaining meanings includes an actuating means for magnetically retaining tool bits within each bit compartment.

Preferably wherein said actuating means includes an actuator assembly slidably received within each bit compartment, wherein said actuator assembly including a magnet housed within a magnet holder for magnetically attracting and retaining a tool bit within a bit compartment.

Preferably wherein said housing further including actuator channels corresponding to each bit compartment, wherein said actuator assembly being slidably received along each actuator channel and bit compartment, wherein said actuator assembly for slidably urging said tool bit longitudinally along said bit compartment.

Preferably wherein said actuator assembly further including a knob connected to said magnet holder, said knob projecting from the exterior of said housing for receiving finger pressure thereon, such that tool bits can be extended and retracted along said bit compartment by urging said knob forwards and backwards along the longitudinal direction which inturn urges said actuator assembly and inturn urges said tool bit forwards and backwards.

Preferably wherein said shaft means and said storing means rotate in unison with said drill chuck.

Preferably, wherein said shaft means rotates in unison with said drill chuck and said storing means is slidably received on said shaft means thereby rotating independently on said shaft means such that said storing means can be held stationary as said shaft means rotates.

Preferably wherein said chuck means including a locking mechanism with a socket for releasably locking tool bits in said socket.

Preferably wherein said locking mechanism being actuated by longitudinally urging said housing between a locked position and unlocked by using a longitudinal locking motion.

BRIEF DESCRIPTION OF THE DRAWINGS

The invention will now be described by way of example only, with references to the followings drawings in which:

FIG. 16 is a schematic front perspective view of an alternate embodiment of a bit holder 200.

FIG. 17 is a rear perspective schematic view of the alternate embodiment bit holder 200 shown in FIG. 16.

DETAILED DESCRIPTION OF THE PREFERRED EMBODIMENT

Figures 10, 11, 12:
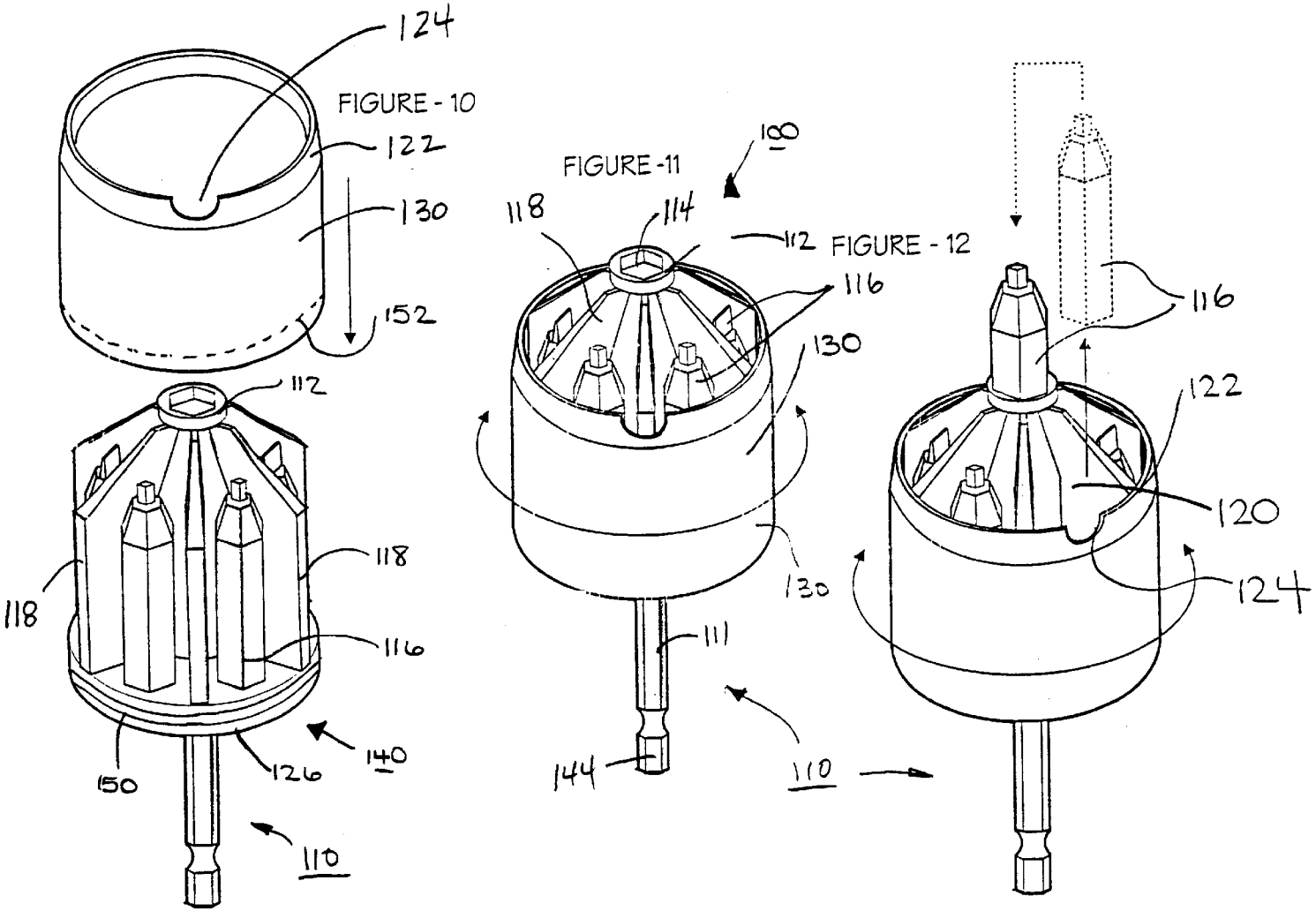
FIG. 10 is a partially exploded perspective view showing the retainer removed from the bit holder.
FIG. 11 is a upright perspective view of the bit holder showing the tool bits nested in their bit compartments.
FIG. 12 is a upright perspective view showing one tool bit inserted in the socket and in shadow the tool bit being removed from an empty bit compartment.
Figure 13:
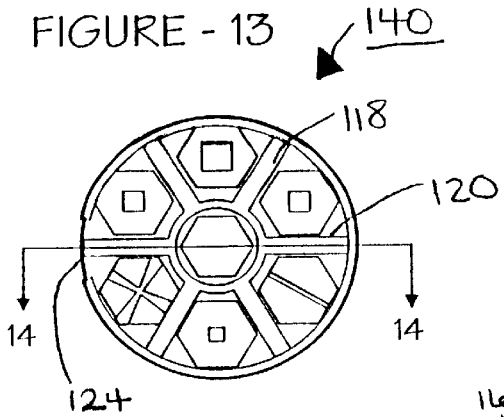
FIG. 13 is a top plan view of the bit holder.
Figure 14:
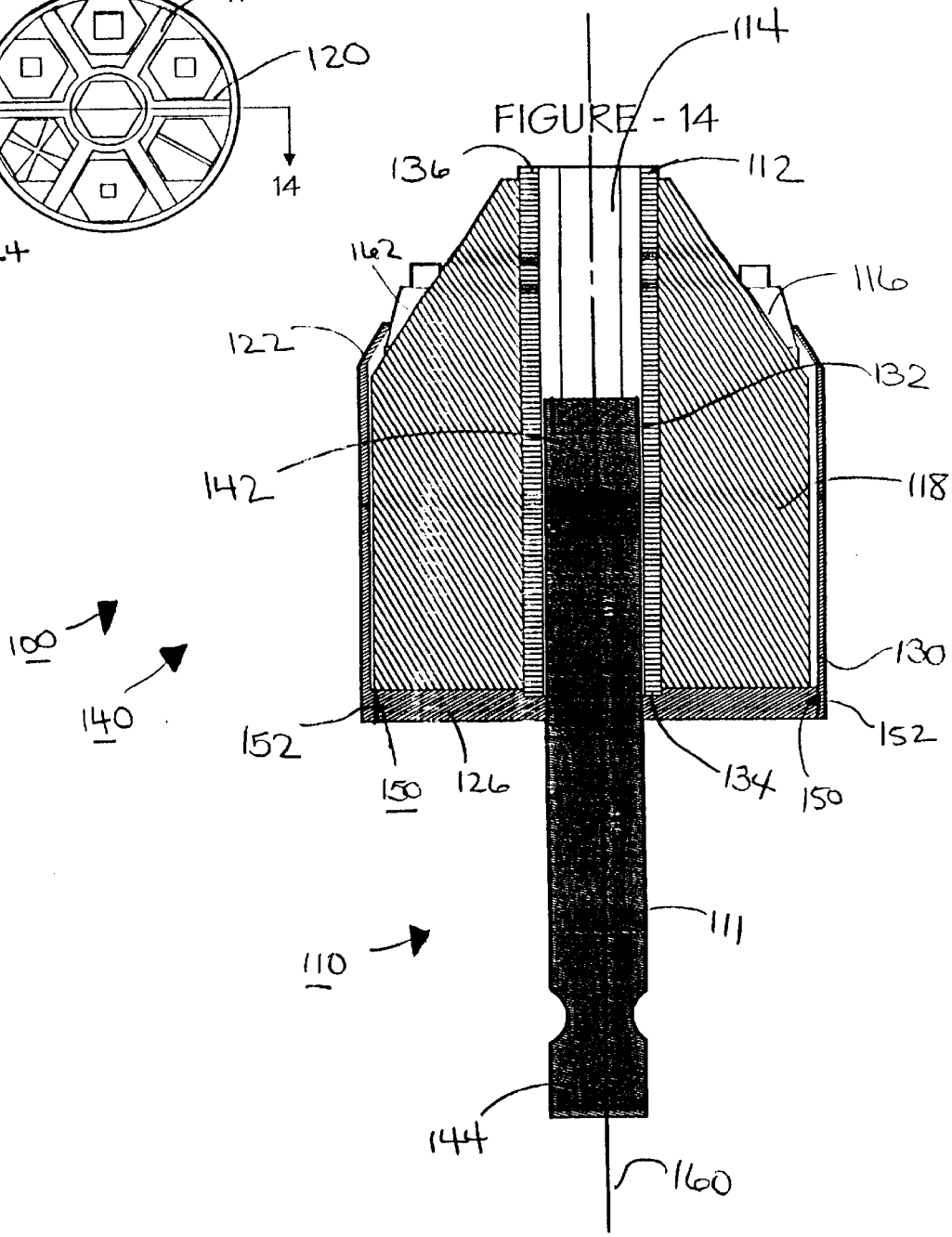
FIG. 14 is a cross-sectional view of the bit holder taken along lines 14—14 in FIG. 13.

Referring to FIGS. 11 and 14 in particular, the present invention of bit holder shown generally as 100 and includes the following components: shaft 110 having a hex portion 111 and a socket portion 112, and a magnet 132, a socket 114, a frame work 140 including base 126, dividers 118 which define bit compartments 120 and a retainer 130 which rotates about shaft bottom 134. Retainer 130 includes a retaining portion 122 and tool bits 116 are housed within bit compartments 120.

Preferably hex driver 110 and hallow shaft 112 are metal components which either can be intragally formed out of one piece of metal and/or are rigidly mounted together as shown in FIG. 14. Which ever construction of hex driver 110 combined with hollow shaft 112 is selected, the end results must ensure that when torque or rotational forces are applied to hex driver 110, hollow shaft 112 is rigidly secured enough to hex driver 110 in order to transmit the torque from hex driver 110 to hollow shaft 112.

Figures 1, 2, 3, 4, 5, 6, 7, 8, 9:
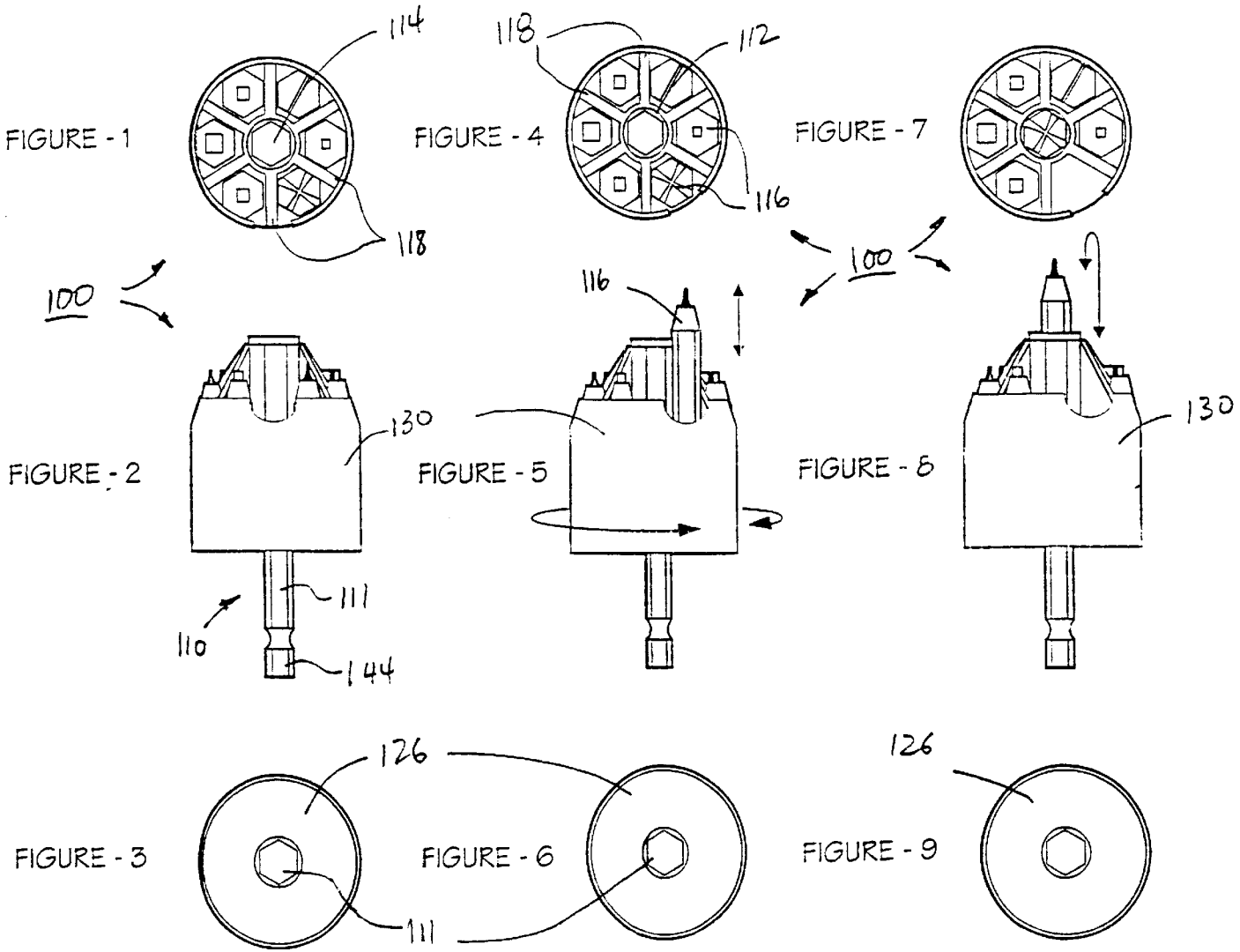
FIG. 1 is a top plan view of the bit holder.
FIG. 2 is a side plan view of the bit holder.
FIG. 3 is a bottom plan view of the bit holder.
FIG. 4 is a top plan view of the bit holder.
FIG. 5 is a side plan view of the bit holder.
FIG. 6 is a bottom plan view of the bit holder.
FIG. 7 is a top plan view of the bit holder.
FIG. 8 is a side plan view of the bit holder.
FIG. 9 is a bottom plan view of the bit holder.

Magnet 132 is imbedded into driver top 142 as shown in FIG. 1 and FIG. 14 and normally there is an interference fit wherein magnet 132 is pressed into a aperture formed in driver top 142. The purpose of magnet 132 is to hold a tool bit 116 into socket 114 and prevent it from falling out of socket 114.

Preferably hex driver 110 is hexagonally shaped of the standard ¼ inch hexagonal driver found on the market place, however it can be dimensioned to other sizes depending upon the application. Similarly socket 114 is a female hexagonal socket adapted to receive hexagonally shaped tool bits 116 having standard dimensions of approximately ¼ inch measured from face to face.

Connected and mounted to the combination of hollow shaft 112 and hex driver 110 is frame work 140 as best shown in FIG. 10 which consists of base 126 and dividers 118. In practice, dividers 118 and base 126 are preferably made by plastic injection moulding, plastic around hex driver 110 and hollow shaft 112.

Once frame work 140 is in place, retainer 130 is placed over bit holder 100 as shown in FIG. 10 whereby a female groove 150 in the outer diameter of base 126 cooperates with male ridge 152 found in the inner diameter of retainer 130, thereby locking retainer 30 onto base 126. It will be apparent to those skilled in the art that many other methods can be used to attach retainer 130 to base 126. The example shown is one of many that can be used to effectively mount retainer 130 onto base 126.

With retainer 130 mounted onto base 126 in this manner, enables retainer 130 to be rotated about a longitudinal axis 160 shown in FIG. 14.

Retainer 130 has a retaining portion 122 which tapers inwardly towards tool bits 116 either impinging upon or coming very close to the tapered shoulders of 162 of tool bits 116 thereby ensuring that tool bits 116 remain within a bit compartment 120.

It will be apparent to those skilled in the art that the retainer 130 can take on various mechanical arrangements not necessarily shown in the diagrams herein. For example the retainer portion 122 may be separate and distinct from the retainer 130. For example a simple rotatable ring having an opening 124 not connected to retainer 130 is possible.

As shown retainer 130 together with frame work 140 defines 6 distinct bit compartments 120 for housing of tool bits 116. There is no reason why this number could be increased or decreased depending upon the final size required of bit holder 100 and also depending upon the total number of tool bits 116 desired to be housed within bit holder 100.

Retaining portion 122 of retainer 130 also has a cut out or retainer opening 124 which can be aligned with a particular bit compartment 120 thereby aligning it with a particular tool bit 116.

In Use

Figure 15:
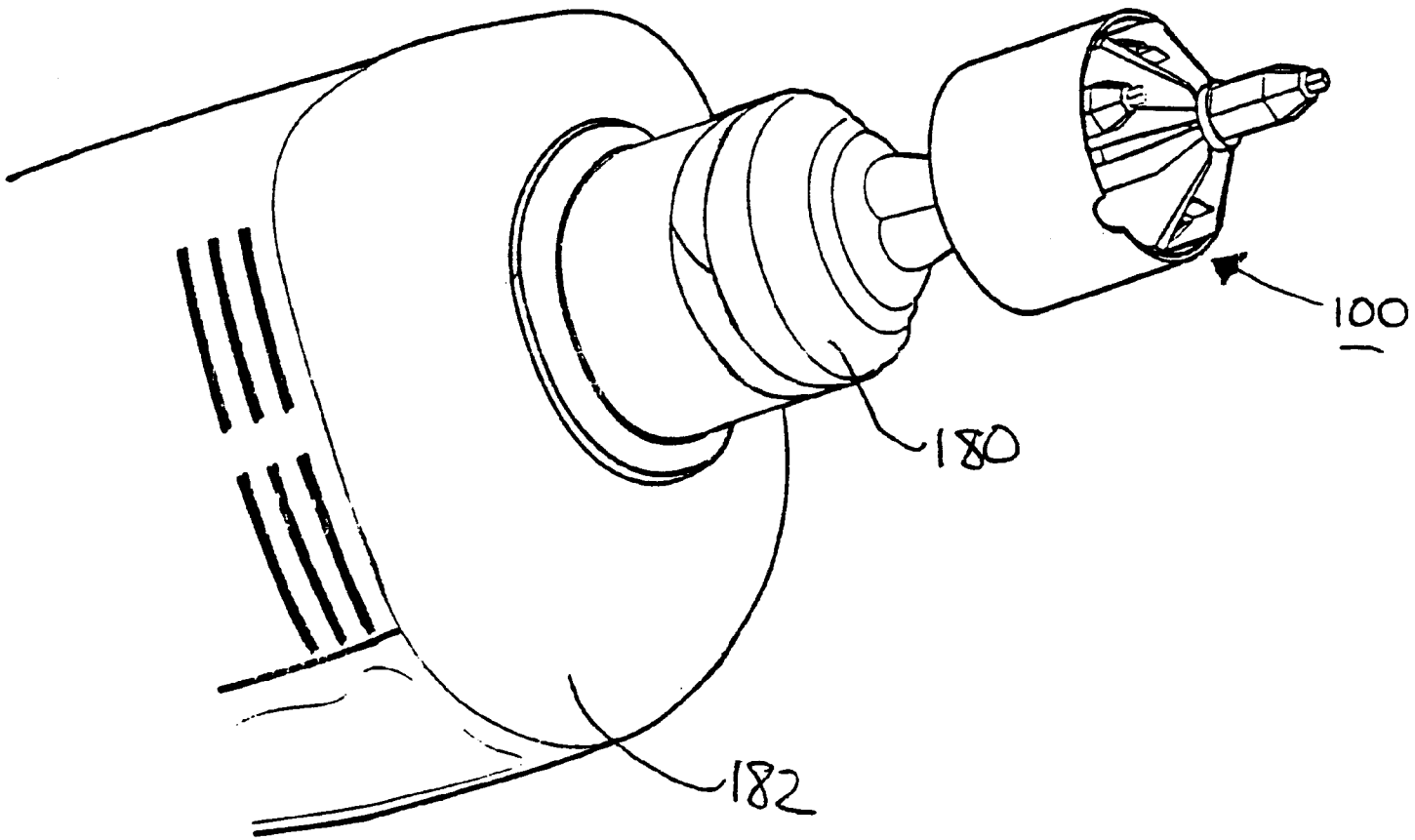
FIG. 15 is a schematic perspective view of the bit holder shown mounted in a drill chuck of a drill.
Figure 18:
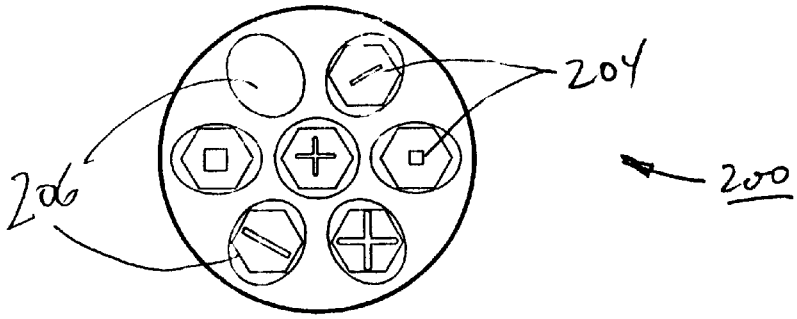
FIG. 18 is a top plan view of the bit holder shown in FIG. 16.
Figure 19:
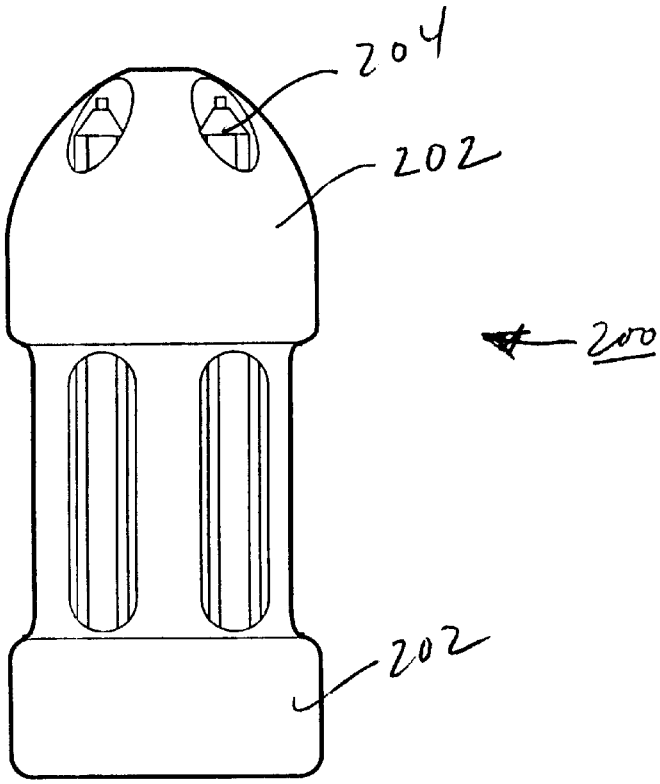
FIG. 19 is a side elevational view of the bit holder shown in FIG. 16.
Figure 20:
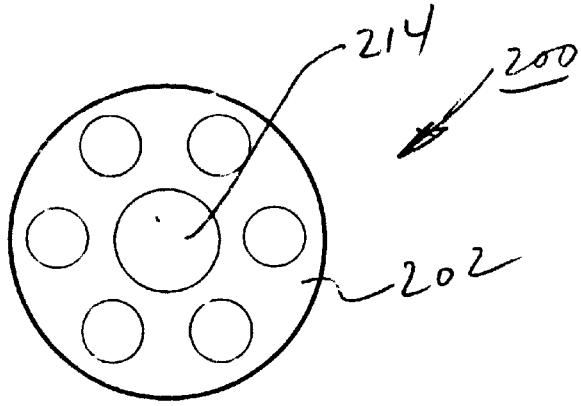
FIG. 20 is a bottom plan view of the bit holder shown in FIG. 16.
Figure 21:
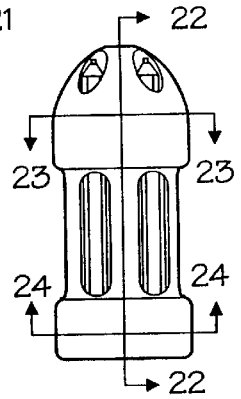
FIG. 21 is a side elevational view of the bit holder shown in FIG. 16.
Figure 22:
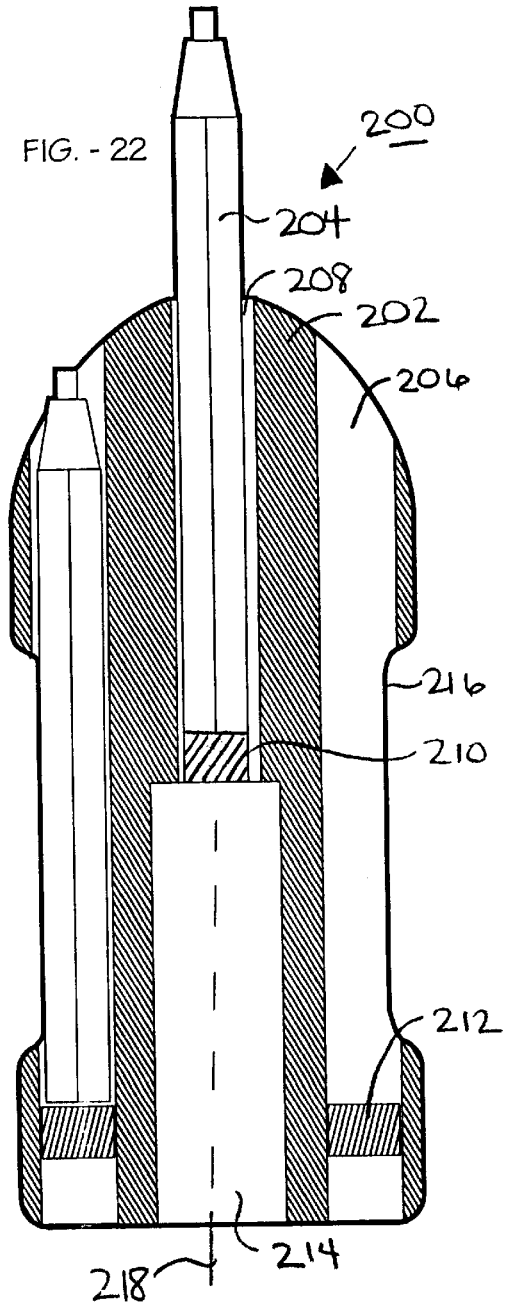
FIG. 22 is a cross sectional view taken along lines 22—22 of FIG. 21.
Figure 23:
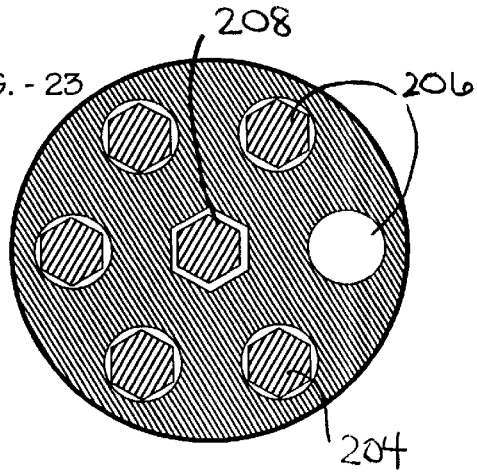
FIG. 23 is a cross sectional view taken along lines 23 shown in FIG. 21.
Figure 24:
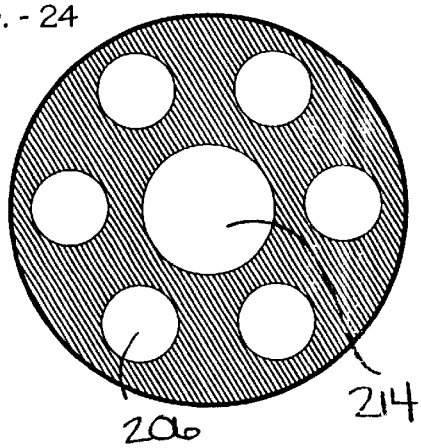
FIG. 24 is a cross sectional view taken along lines 24—24 shown in FIG. 21.

In use driver bottom 144 of bit holder 100 as best shown in FIG. 15 is mounted into a drill chuck 180 and drill 182. With bit holder 100 mounted in drill chuck 180, a particular tool bit 116 is selected from bit holder 100 by rotating retainer 130 such that retainer opening 124 aligns with the desired bit compartment 20 housing the desired tool bit 116. Retainer opening 124 is so dimensioned as to allow removal of tool bit 116 from its bit compartment 120 thereby positioning tool bit 116 into socket 114 where it is retained thereby magnet 132.

The balance of tool bits 116 in this case the five not retained in socket 114 are retained in their perspective bit compartments 120 by retaining portion 122 of retainer 130.

With a tool bit 116 mounted in socket 114, drill 182 can now be actuated there by rotating the entire bit holder 100 and the end of tool bit 116 can be gauged with a screw or whatever work piece for utilizing the selected tool bit 116.

When none of the tool bits 116 is desired, the tool bit 116 found within socket 114 is removed back to its respective bit compartment 120 and retainer 130 is rotated such that retainer opening 124 aligns with a divider 118 as shown in FIG. 11, thereby locking all of the tools bits 116 and their respective bit compartments 120.

The advantage of bit holder 100 is that the bits are easily selectable since they are located very close to the drill chuck 180 and the work piece being used. It will further be appreciated that a particular tool bit 116 can be easily and quickly selected and placed back into its respective bit compartment 120 such that the tool bits 116 do not become lost.

Further, it will appreciated by those skilled in the arts that various lengths of tool bits 116 can be used depending upon the dimensions of bit holder 100 in addition to the tool bits of the type shown, any standard type tool bit can be used, including drill bits and/or other bits as long as they are adapted to be received cooperatively within socket 114.

As drill chuck 180 rotates thereby rotating hex driver 110, there in turn rotating hollow shaft 112, which there in turn rotates the tool bit 116 found within socket 114, the tool bit within socket 114 can impart torque and/or turning forces onto whatever work piece it is applied to.

It will be apparent to those skilled in the art that the above described mechanism for the selection of tool bits can also be adapted for use as a manual driver. For manual drivers driver bottom 144 instead of being mounted to chuck 180 would be securely mounted to a handle not shown in the drawings. The handle would be designed to fit comfortably in a hand. Bit holder 100 would be rotated by the manual turning of a handle which rigidly connected to bit holder 100.

Presently Preferred Embodiment FIGS. 16 through 37

Referring now to a presently preferred embodiment of the invention which is depicted in FIGS. 17 through 37. The presently preferred invention, a bit holder shown generally as 200 in FIG. 22 includes the following major components, namely housing 202, tools bits 204, six bit compartments defined in housing 202, nested symmetrically about a longitudinal axis 218 of housing 202, a hexagonal socket defined centrally along longitudinal axis 218 within housing 202 for receiving tools bits 204 therein, magnets 210 located at the base of hex socket 208 and magnets 212 located near the bottom of bit compartments 206 for magnetically retaining tools bits 204 within either bit compartment 206 or hex socket 208, a threaded aperture in the rear portion of housing 202 and fix compartment openings 216 corresponding to bit compartment 206 for the purpose of enabling the user to slide a tool bit tool four out of its bit compartment 206 by applying finger pressure.

In Use

Figures 25, 26, 27:
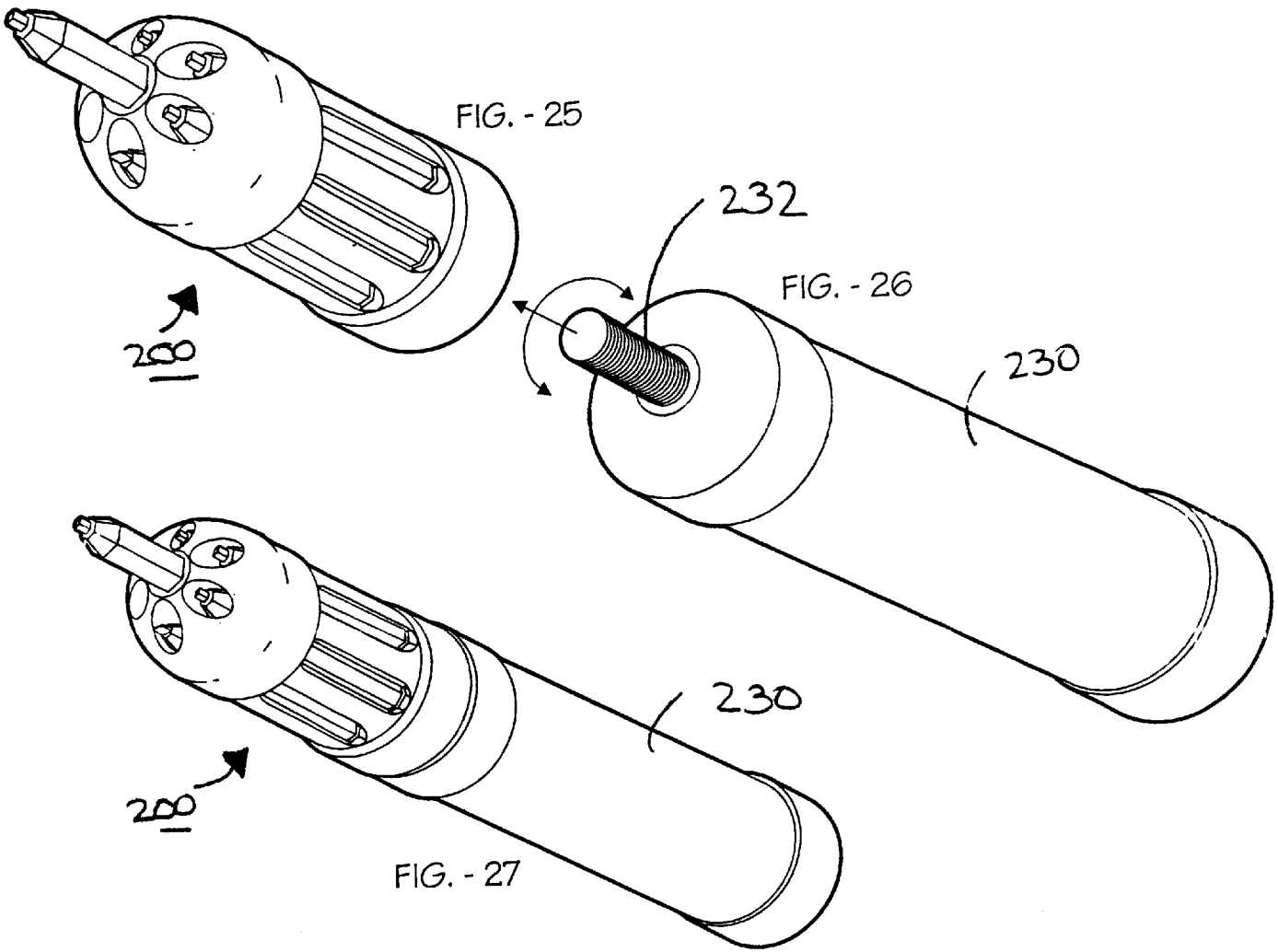
FIG. 25 is an assembly drawing shown the presently preferred bit holder 200 for mounting onto a handle.
FIG. 26 is a front schematic perspective view of a handle for mounting of bit holder 200 thereon.
FIG. 27 is an assembled schematic perspective front view of bit holder 200 mounted onto handle 230.
Figure 28:
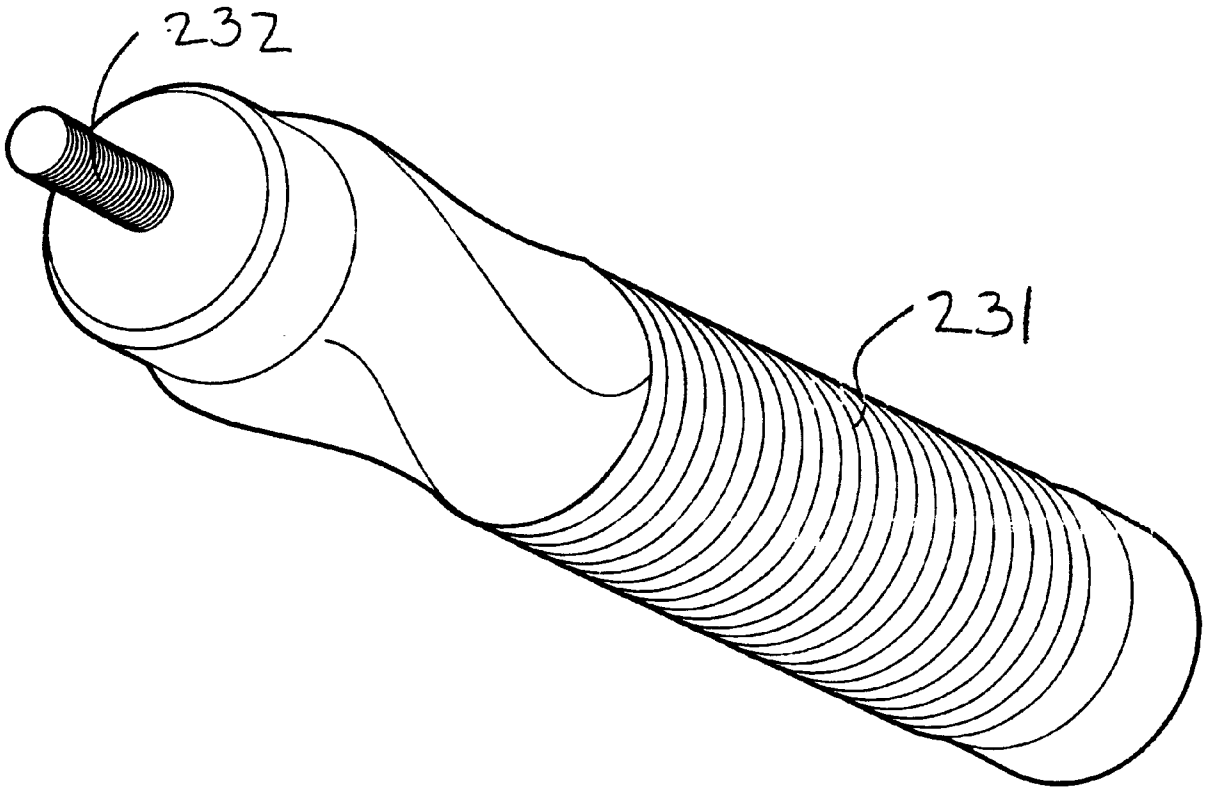
FIG. 28 is an alternate embodiment of the handle shown in FIG. 26.
Figures 29, 30, 31, 32:
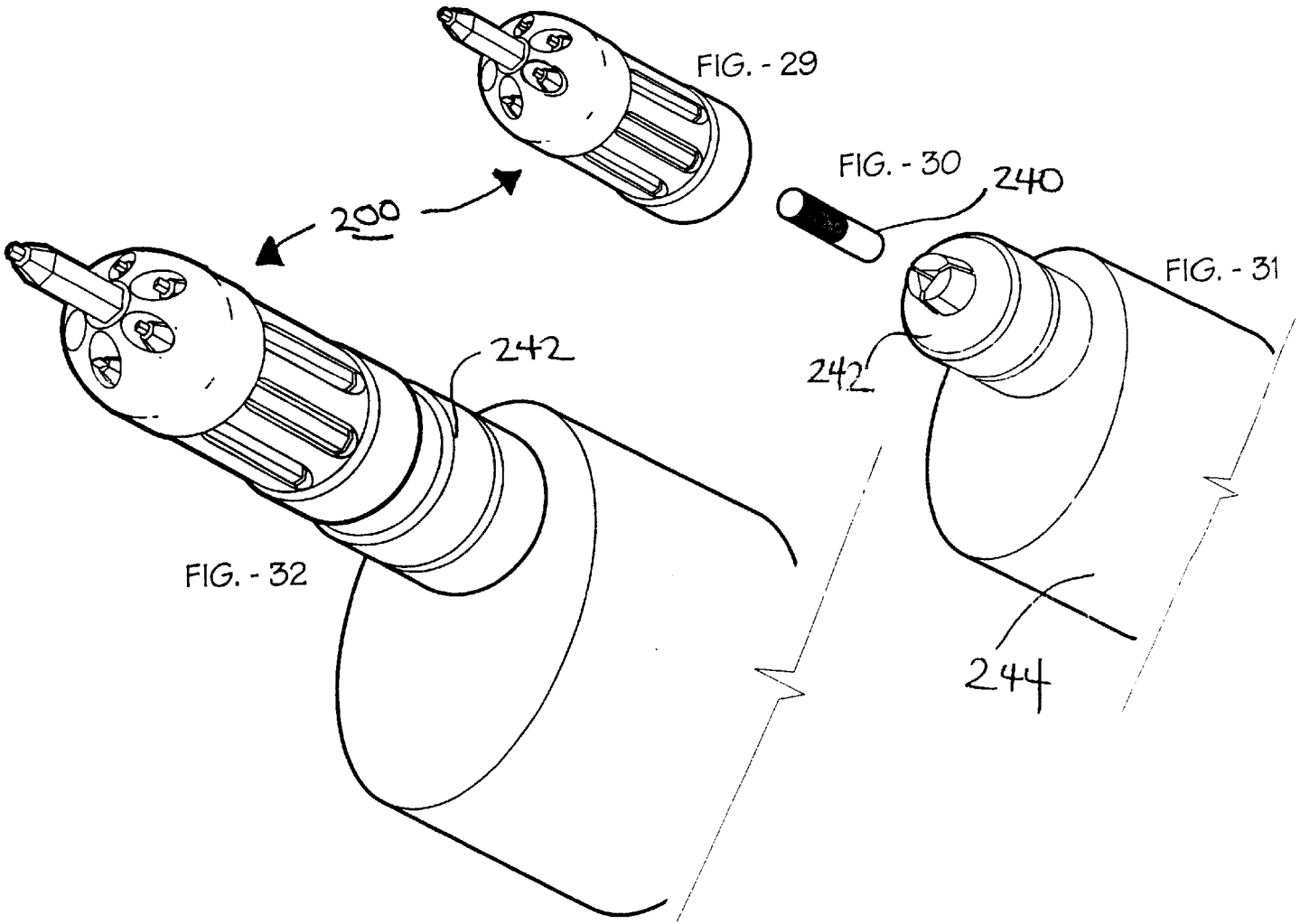
FIG. 29 is a schematic front perspective view of the bit holder shown being assembled into the chuck of a drill.
FIG. 30 is the adapter shaft required for mounting bit holder onto a drill chuck.
FIG. 31 is a partial front schematic perspective view of a drill chuck together with a portion of the drill.
FIG. 32 is an assembled view of the bit holder mounted onto a drill chuck of a drill.

Bit holder 200 can be used as a manual screw driver by affixing it to a handle 230 shown in FIG. 26 via threaded shaft 232 located symmetrically along longitudinal axis 218. Threaded shaft 232 is threadably received within threaded aperture 214 of bit holder 200 thereby securely joining bit holder 200 to handle 230 as shown in the assembled condition in FIG. 27. This configuration, bit holder 200 can be used as a manual bit driver and tools bits 204 can be selected by slidably removing tool bit 204 out of its bit compartment 206 by using finger pressure to slide the tool bit 204 out of bit compartment 206 and manually positioning it slidably into hex socket 208 until magnet 210 holds tool bit 204 within bit socket 208. In this manner a total of seven tool bits can be held magnetically in place by bit holder 200 and each bit can be selected according to need.

Referring now to FIGS. 29, 30, 31 and 32 by using adapter shaft 240 which is threaded on one end to be threadably received within threaded aperture 214 of tool bit 204 and is smooth and/or hexagonally shaped on the other end to be received in drill chuck 242 of a standard portable drill 244 as depicted. By using adapter shaft 240, bit holder 200 can be mounted into a drill chuck 242 and thereby bit holder 200 can be used as a bit driver on a drill 244.

Figures 33, 34, 35, 36, 37:
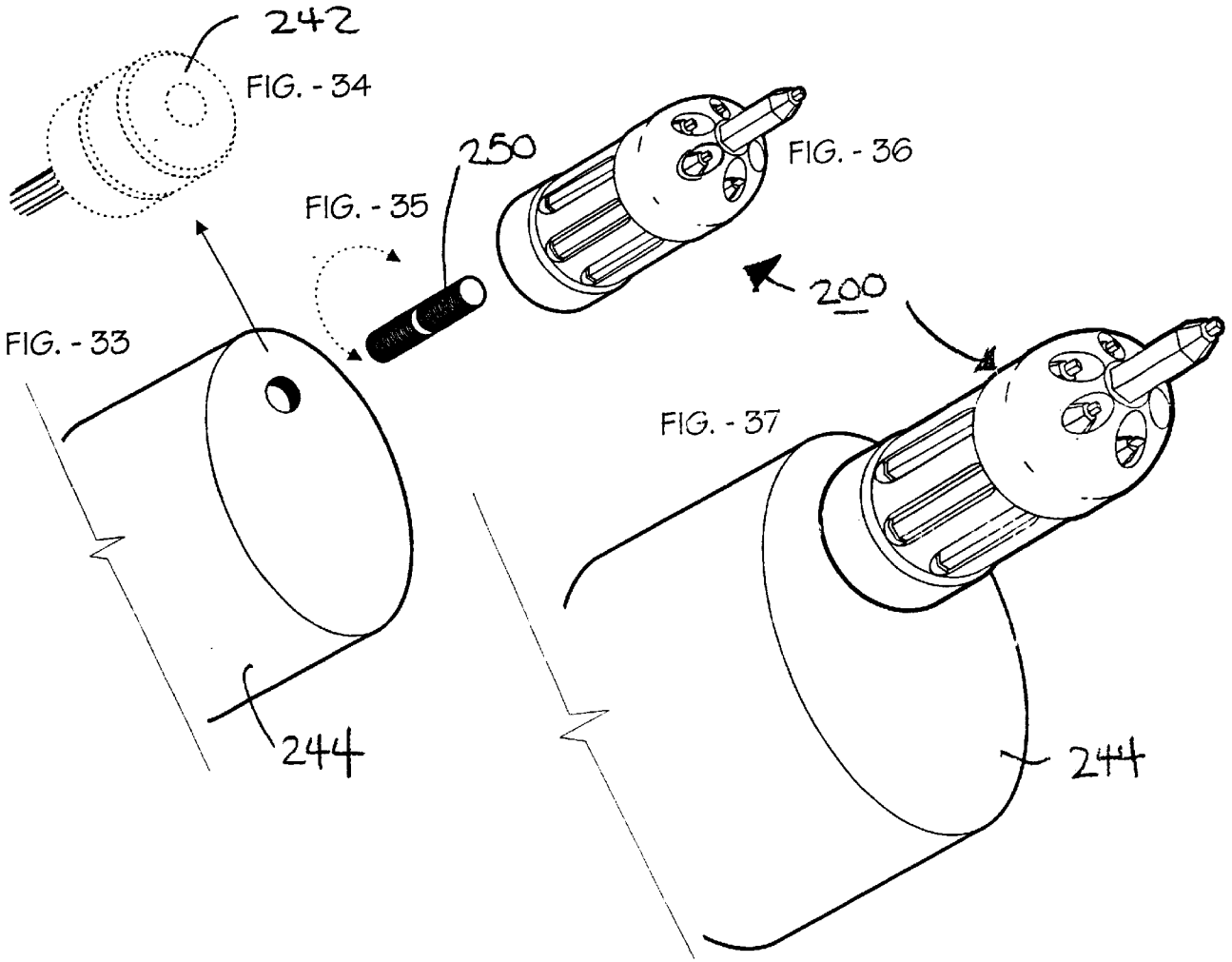
FIG. 33 is a schematic perspective view of a power drill body with the chuck removed.
FIG. 34 is a schematic ghost outline of a drill chuck removed from a drill.
FIG. 35 is a schematic perspective view of a threaded shaft joining a drill with a drill chuck.
FIG. 36 is a schematic front perspective view of the bit holder.
FIG. 37 is an assembly drawing showing the bit holder replacing a conventional drill chuck on a drill.

Referring now to FIGS. 33, 34, 35 and 37, most commercially available drills 244 have a removable drill chuck 242 as shown in FIG. 34. This drill chuck will either leave behind a threaded shaft 250 which is removable and/or projects out of the end of drill 244 where drill chuck 242 was previously mounted. This threaded end is normally either ⅜ fine thread or ½ fine thread and threaded aperture 214 is adapted in size and threading to be threadably received onto threaded shaft 250 which is either integrally part of drill 244 or can be sold as an adapter piece to allow one to mount bit holder 200 directly onto drill 244. In this manner, bit holder 200 essentially replaces drill chuck 242, thereby reducing the weight and the cantilever action of bit holder 200 and minimizes the distance that bit holder 200 projects away from drill 244. This makes for a much more compact installation than that shown in FIG. 32, reduces weight and certainly if of interest to contractors who are constantly using bit drivers.

Alternate Presently Preferred Embodiment

Figure 38:
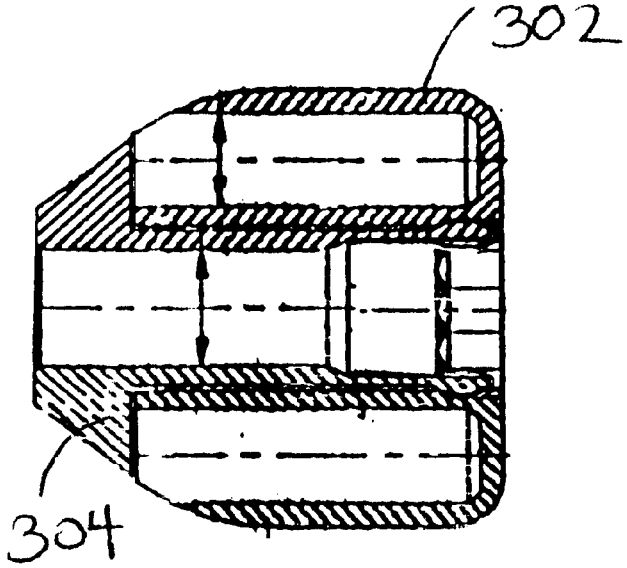
FIG. 38 is a cross sectional view of an alternative embodiment of the present invention, namely bit holder 300.
Figure 38:
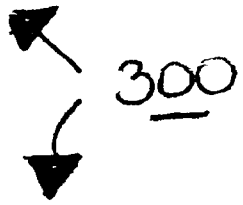
Figure 39:
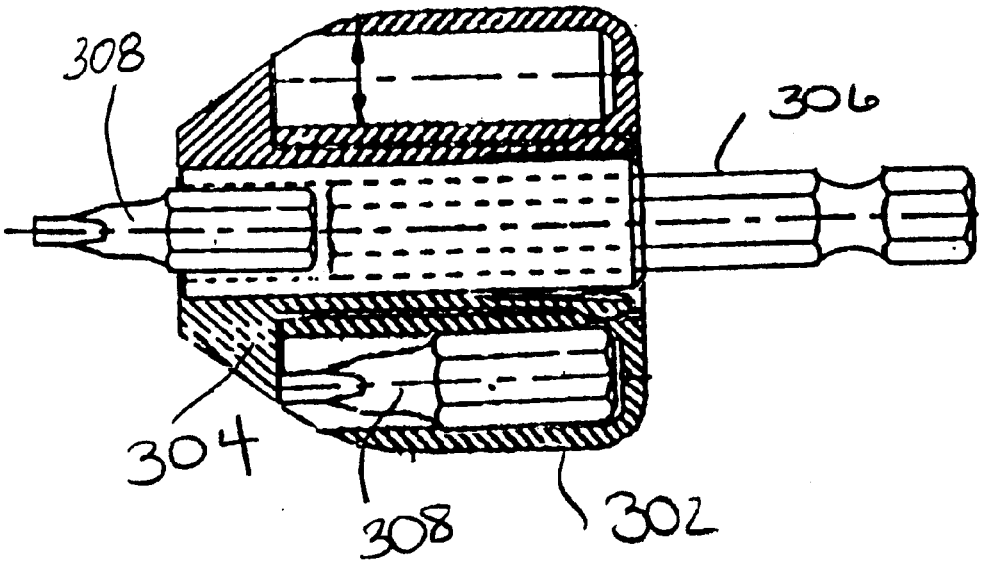
FIG. 39 is a cross sectional view of bit holder 300 showing shaft 306 in place.
Figure 40:
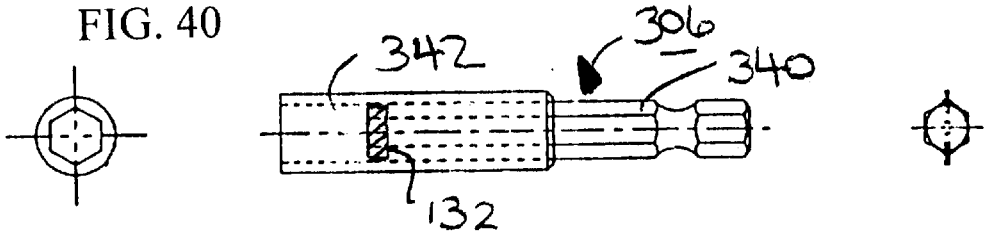
FIG. 40 is a front, side and bottom plan view of a shaft which is part of bit holder 300.
Figure 41:
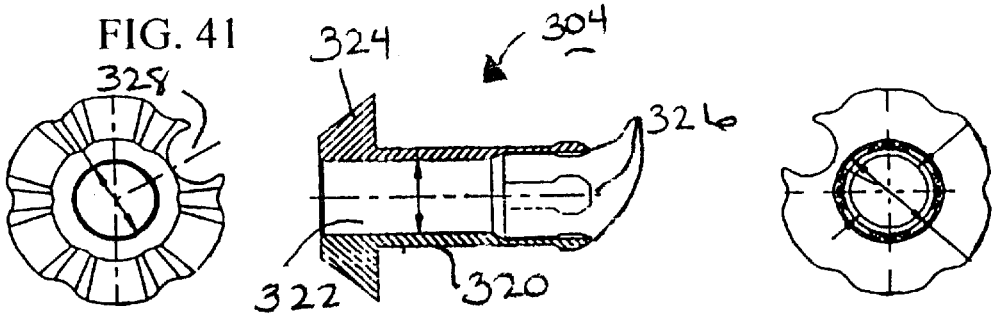
FIG. 41 is a top, side and rear plan view of a sleeve which is part of bit holder 300.
Figure 42:
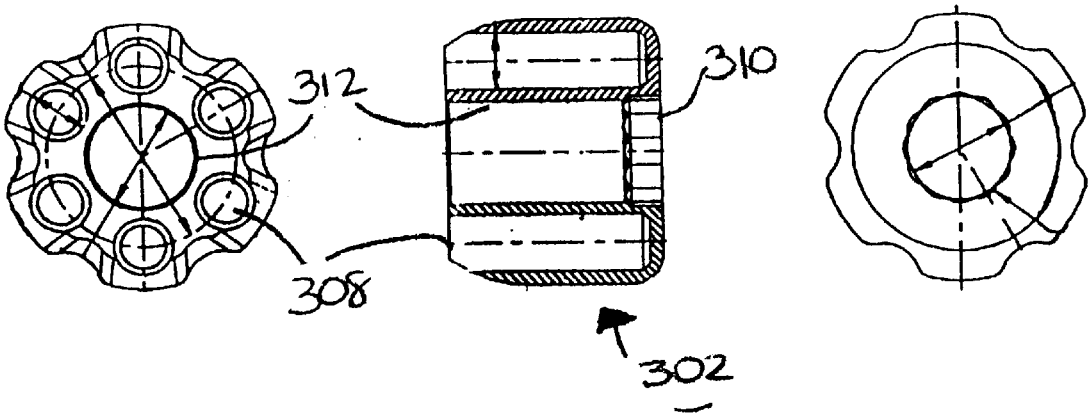
FIG. 42 is a front, side and rear plan view of a housing which is part of bit holder 300.
Figure 43:
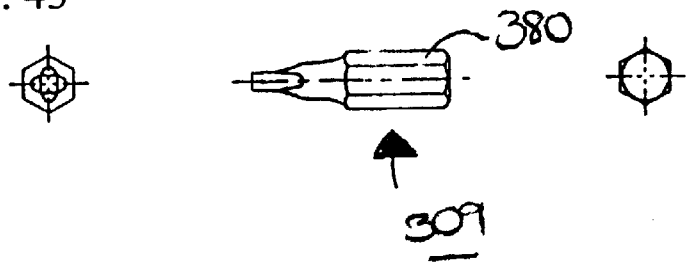
FIG. 43 is a front, side and rear plan view of a tool bit which is part of bit holder 300.
Figure 44:
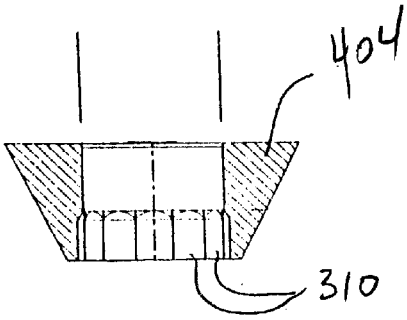
FIG. 44 is a cross sectional view of a sleeve.
Figure 45:
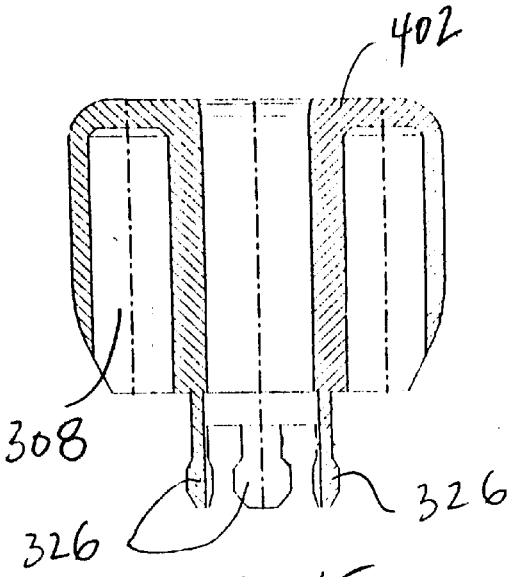
FIG. 45 is a cross section view through a housing.
Figure 46:
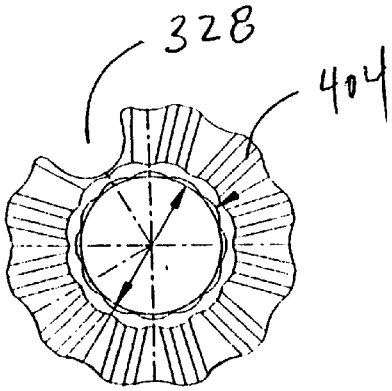
FIG. 46 is a front elevational view of the sleeve shown in FIG. 44.
Figure 47:
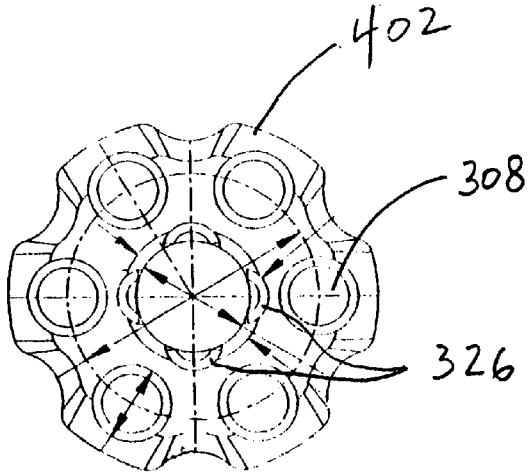
FIG. 47 is a front elevational view of the housing shown in FIG. 45.

An alternate presently preferred embodiment is depicted in FIG. 38 and on showing the present invention a bit holder 300 which includes the following major components housing 302, a sleave 304, shaft 305, tool bit 309 all of which are assembled together as shown as FIG. 39.

Referring first of all to housing 302 which is preferably injection molded in plastic, it includes the following major components, namely six bit compartments 308 and inter diameter which mates onto out diameter 320 of sleave 304 and a series of twelve groves 310 and the rear portion of housing 302 which comparatively engage with tongues 326 found in sleave 304.

Sleave 304 includes the following major components, retainer portion 324, inner diameter 322 for fitting onto socket portion 342 of shaft 306, outer diameter 320 which acts as a baring surface on which housing 302 rotates and tongue 326 extending rearwardly and cooperatively engaging within grooves 310 of housing 302. Retainer portion 324 further includes an opening 328 through which tool bit 309 may pass through without impediment.

Shaft 306 includes the major elements hex portion 340 which is a hexagonally shaped shaft with a socket portion 342 which is normally metallic in material having a magnet 132 wherein said socket portion 342 is dimensioned to receive the hexagonal shaft of tool bit 308.

Assembly and In Use

The components described above are firstly assembled as follows. The inner diameter 312 of housing 302 fits slidably over the outer diameter 320 of sleave 304 and are slid over until tongue 326 engage with grooves 310 found within housing 302. This assembly of housing 302 and sleave 304 is shown in FIG. 38. This sub assembling is then press fit onto the socket portion 342 of shaft 306 and the inner diameter 322 of sleave 304 is dimensioned to fit interferingly with the outer diameter of socket portion 342, such that when sleave 304 together with housing 302 are press fit onto socket portion 342 of shaft 306 it is rigidly held in place on shaft 306.

The inner diameter 312 of housing 302 is dimensioned to slidably and rotatably fit over outer diameter 320 of sleave 304 such that housing 302 together with tool bit 309 located within bit compartment 308 can rotate around sleave 304 which is stationary and rigidly positioned onto socket portion 342 of shaft 306. Groove 310 cooperatively engaging with tongues 326 of sleave 304 provide resistance to turning of housing 302 which can be overcome by hand pressure, namely manually turning housing 302 and rotating it around sleave 304 such that a clicking action occurs as it is moved from one groove 310 to the next. There are essentially double as many grooves 310 as there are bit compartment 308, such that if there are six bit compartments as shown there are twelve grooves 310 and therefore there are twelve positions to which housing 302 can be moved to. In six of those positions, opening 328 coincides with the opening on one end of bit compartment 308, thereby allowing a tool bits 309 to freely be removed from bit compartment 308 adjacent to opening 328. By moving the housing 302 one click further, this locks all of the bits within their compartments and none of the tools bits 309 can be removed from bit compartment 308 since they are being blocked off by retainer portion 324 of sleave 304.

A tool bit 309 is selected from one of its bit compartment 308 as described above and placed in the socket portion 342 of shaft 306 and held in place by magnet 132. As previously shown in FIG. 15, the hex portion 340 of bit holder can be mounted into a chuck of a drill as shown in FIG. 15 in identical fashion as bit holder 100 is. In this manner, bit holder 300 can be used to quickly and effectively select up to seven bits which can be neatly held within bit holder 300 and organized in such a fashion that they are not lost.

Alternate Embodiment

Figure 48:
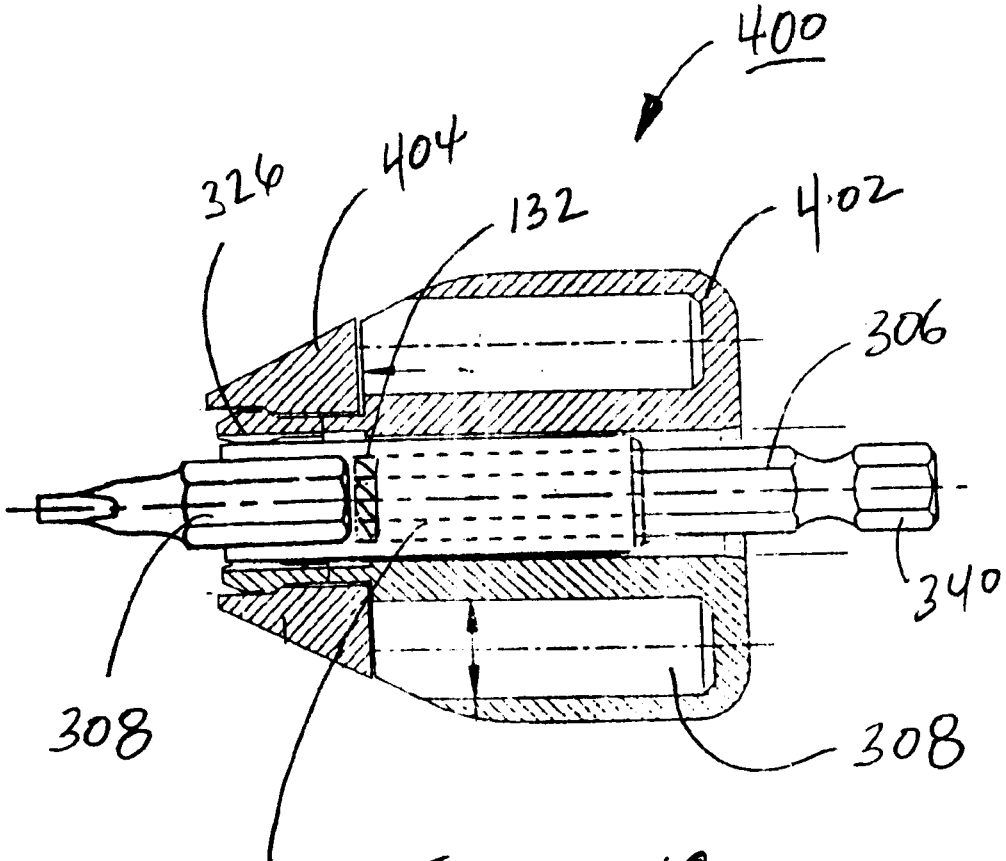
FIG. 48 is an alternate embodiment of a bit holder shown in the assembled state from the components depicted in FIGS. 44 through 47, wherein bit holder 400 is a cross sectional view of the bit holder with a shaft in place including a housing sleeve and bit.
Figures 49, 50, 51:
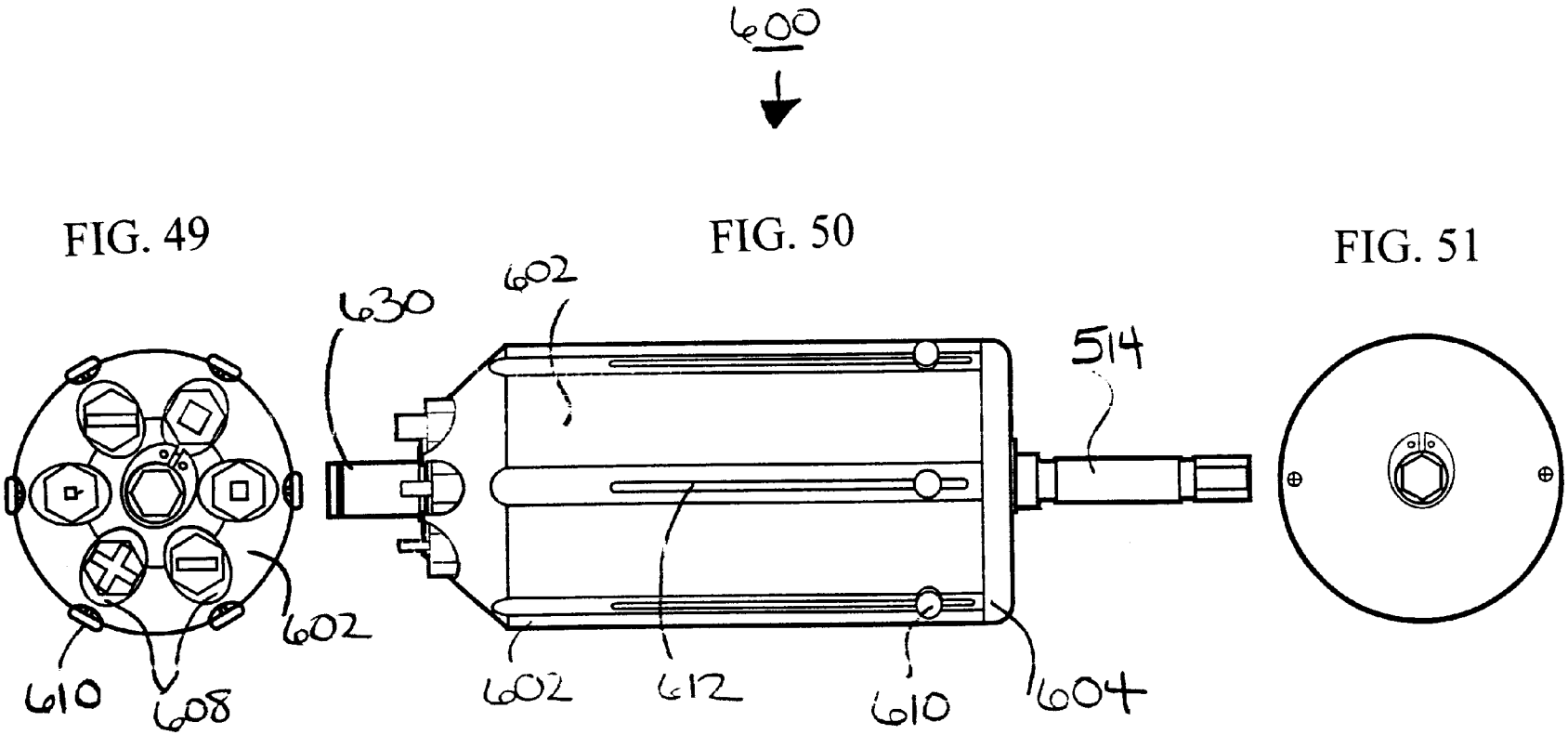
FIG. 49 is a front plan view of the bit holder shown in FIG. 50.
FIG. 50 is a side elevational view of the bit holder.
FIG. 51 is a rear plan view of the bit holder shown in FIG. 50.
Figures 52, 53:
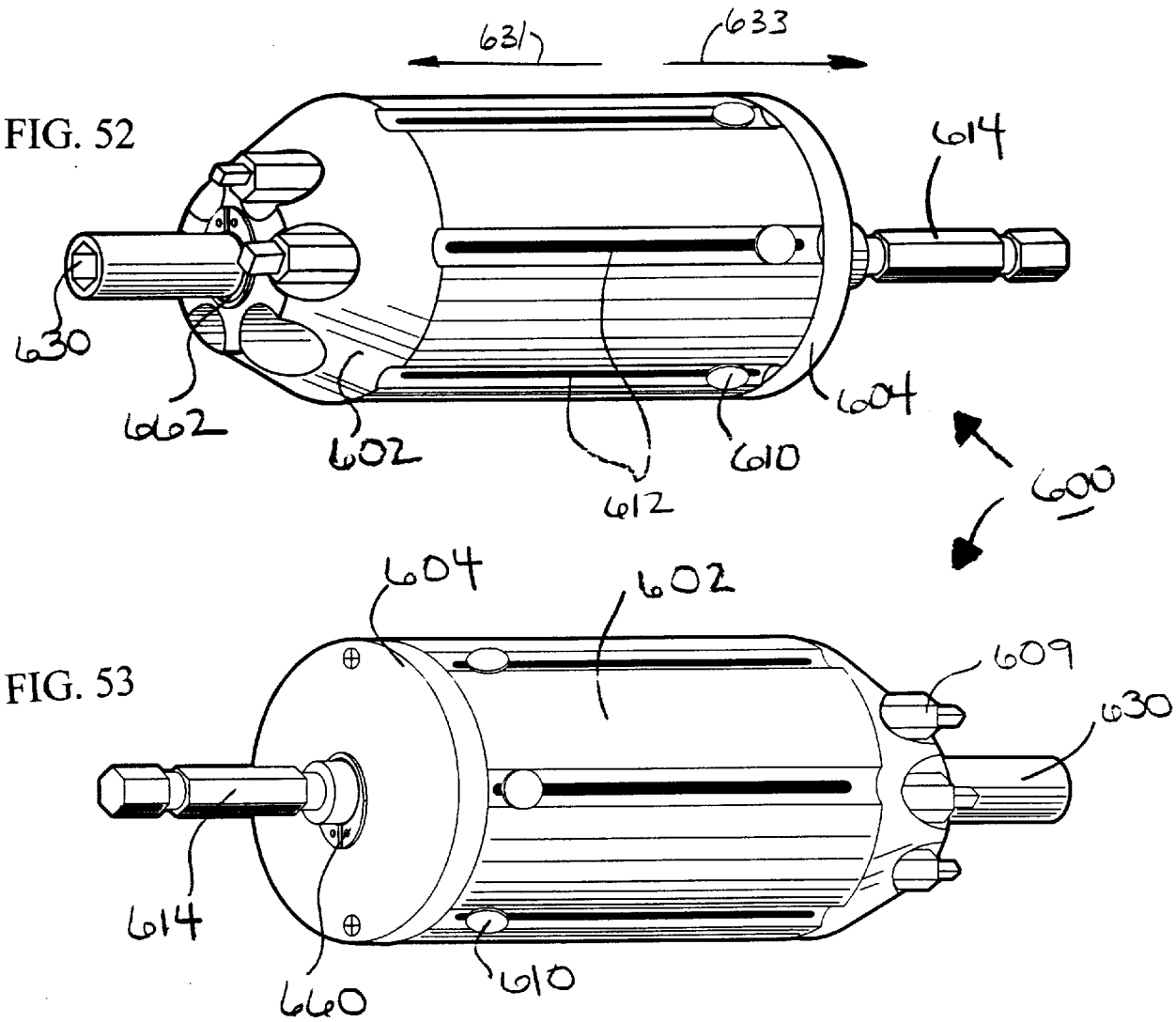
FIG. 52 is a schematic front perspective view of the bit holder shown in FIG. 50.
FIG. 53 is a rear schematic perspective view of the bit holder shown in FIG. 50.
Figure 54:
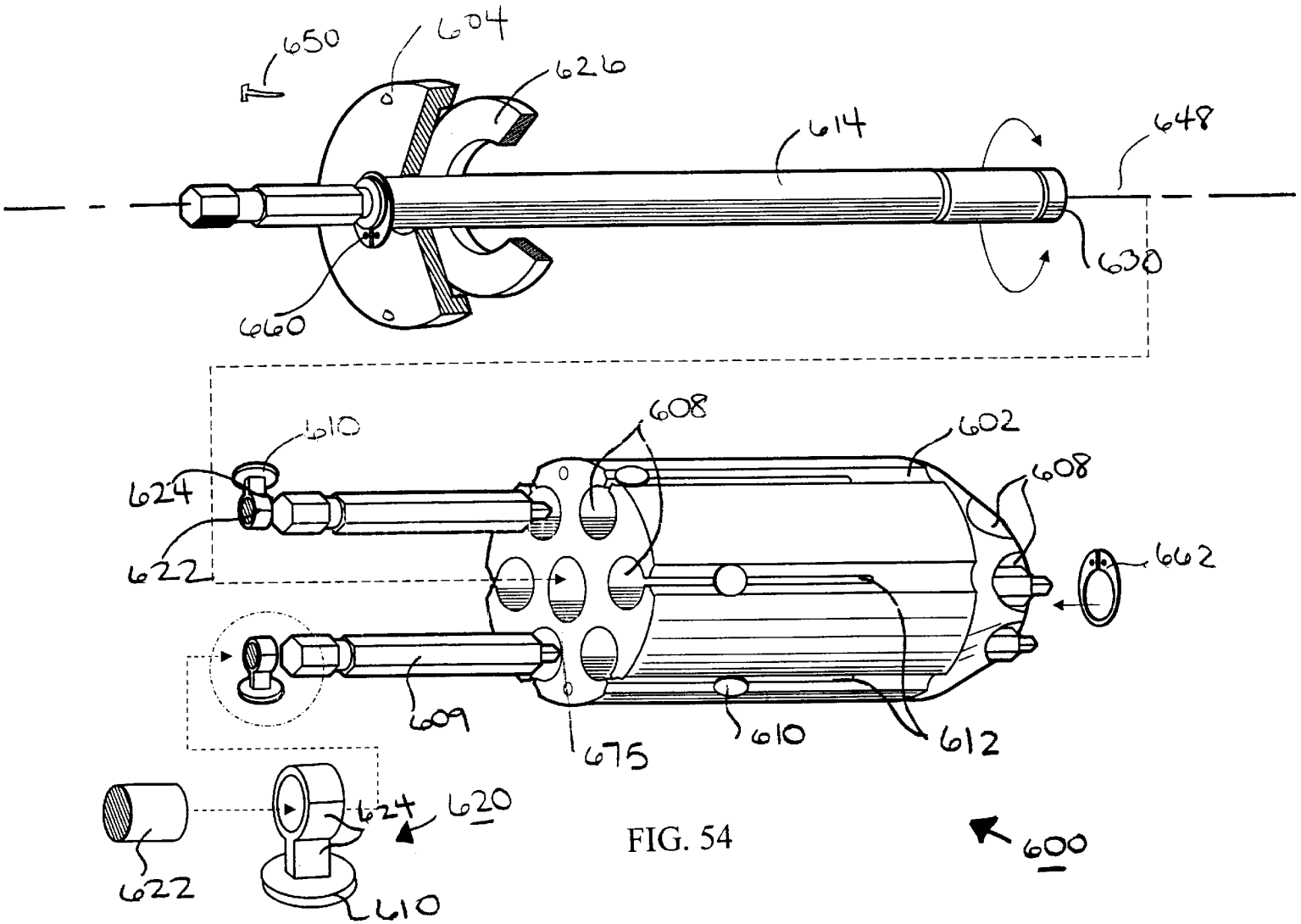
FIG. 54 is an exploded assembly view of the bit holder shown in FIG. 50.

FIGS. 44 through 48 inclusive show an alternate embodiment and a bit holder shown generally as 400 in the assembled state in FIG. 48. Bit holder 400 is very similar to bit holder 300, the major difference being that the tongue and grooves which are located nearest the back of the body 302 for bit holder 300 have been moved to the front of the body 402 for bit holder 400. In order to have the tongue 326 and grooves 310 moved to the front of body 402, sleeve 404 is modified to have the grooves 310 defined therein and the tongues 326 are placed on the front of body 402 rather than on the rear of sleeve 304 as in the previous embodiment. In all other aspects the presently preferred embodiment of bit holder 400 operates and functions in an identical and analogous manner to bit holder 300 with the exception that rather than rotating body 302, sleeve 404 is rotated relative to body 402 which is stationarily mounted onto shaft 306 and sleeve 404 rotates about the tongues 326 and about shaft 306 as shown in FIGS. 44 through 48. In the previous embodiment bit holder housing 302 was rotatably mounted onto sleeve 304 whereas in the presently preferred embodiment, bit holder housing 402 is securely mounted onto the socket portion 342 of shaft 306 and sleeve 404 is mounted over tongues 326 which are now part of housing 402.

In this manner it would apparent to those skilled in the art that is irrelevant whether or not sleeve 404 or body 402 are rotating, but what is important is that either the body or the sleeve are rotating relative to each other and that the tongue 326 and groove 310 mechanism used can be placed either in the forward portion or the rearward portion of bit holder 400 or 300 as shown in the Figures. For that matter the tongue and groove mechanism can be mounted in a different location and yet render the same function.

New Matter Entered in this Continuation in Part

Alternate Embodiment of Bit Holder

An alternate embodiment of the Bit Holder described above is shown in the attached FIGS. 49 through 57. The bit holder shown generally as 600 includes the following major component namely, housing 602 defining a number of bit compartments 608 and including end cap 604, a through shaft 614 including a socket 630 at one end for housing bit 609 via a magnet 631 and held in place relative to housing 602 using cir clips 660 and 662. Bit holder 600 further includes an actuator assembly 620 which includes knob 610, magnet holder 624 and magnet 622. In addition, a washer 626 is found under end cap 604 which is held in place with fasteners 650 onto housing 602. Bit holder 600 is symmetrical about longitudinal axis 648 which passes centrally through, through shaft 614. Bit housing 602 also includes actuator channel 612 consisting of grooves defined within housing 602 which run longitudinally and partially along each bit compartment 608 for the purpose of receiving magnet holder 624 slidably along each actuator channel 612.

Tool bits 609 are extended and retracted along bit compartment 608 by urging knob 610 which in turn urges actuator assembly 620 which in turn slidably urges bit 609 forwards 631 and backwards 633 within bit compartment 608. Bit 609 is shown in the retracted position 643 with magnet 622 contacting the end of bit 609 and also washer 626. Bit 609 is also shown in the partially extended position 641 wherein magnet 622 is only contacting the tool bit 609. In the fully extended position not shown, actuator assembly is urged to the extreme forward 631 position along actuator channel 612.

In order to assemble bit holder 600, firstly actuator assemblies 620 are slidably received within each bit compartment 608 and actuator channel 612. Thereafter, washer 626 is placed on the rearward portion of housing 602 and held in place by an end cap 604 which is fastened onto housing 602 using fastener 650. Thereafter through shaft 614 is slidably received within shaft opening 675 and is held in place using cir clips 660 and 662 on the front and rearward portion of housing 602 as shown in the diagrams. Through shaft 614 can rotate independently of housing 602 on bearing surface 690 of housing 602. Finally, tool bits 609 are inserted from the front of housing 602 into each bit compartment 608 and also into socket 630 of through shaft 614 if desired.

In use once bit holder 600 has been assembled, a person skilled in the art can see that one can select any of the bit 609 housed within each bit compartment 608 of bit holder 600 by simply forwardly urging an actuator assembly 620 corresponding to the bit compartment 608 which contains the tool bit 609 one desires to place into socket 630. Finger pressure is used on knob 610 of magnet holder 624 to release the magnetic attraction between magnet 622 and washer 626, thereby forwardly urging bit 609 out of its bit compartment 608. Once the actuator assembly 620 has been urged to its most forward position along actuator channel 612 of a bit compartment 608, the bit 609 must then be manually removed by manually gripping bit 609 to release the bit 609 from the magnet 622. Once a bit 609 has been released in such a manner, it can than be simply placed into socket 630 where it is retained by magnet 631. One skilled in the art can see that a bit 609 is held in bit compartment 608 by the magnetic attraction of magnetic 622 with the rearward portion of bit 609 and also at the other side of the magnet 622 with magnetic attraction with washer 626.

Figure 55:
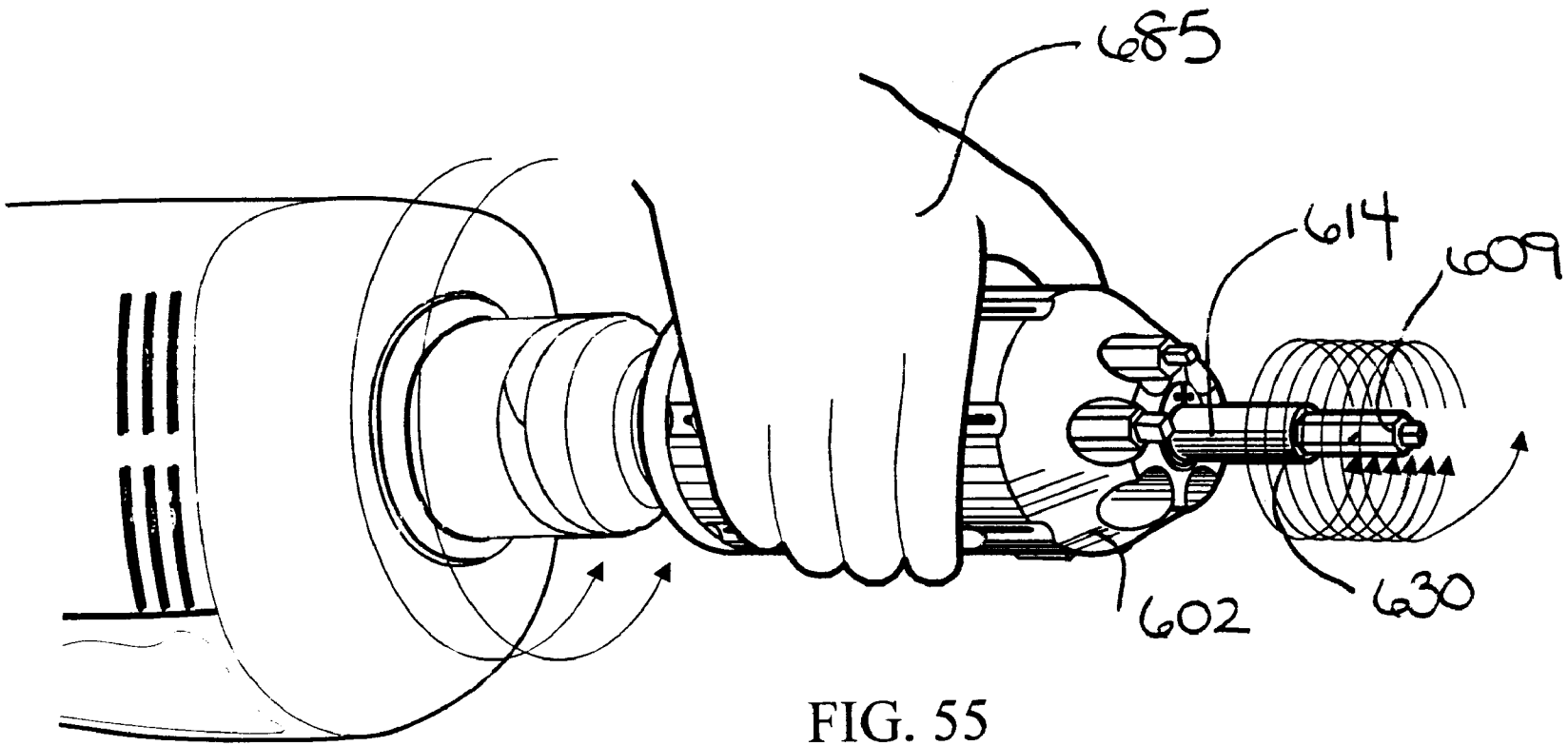
FIG. 55 shows the bit holder mounted onto a drill chuck.
Figure 56:
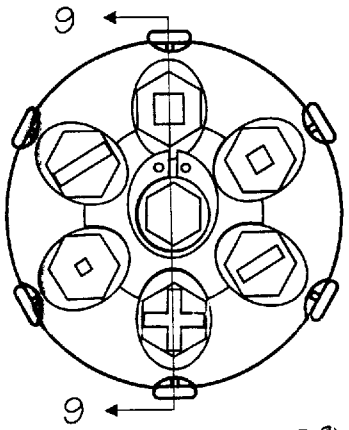
FIG. 56 is a front plan view of the bit holder shown in FIG. 50.
Figure 57:
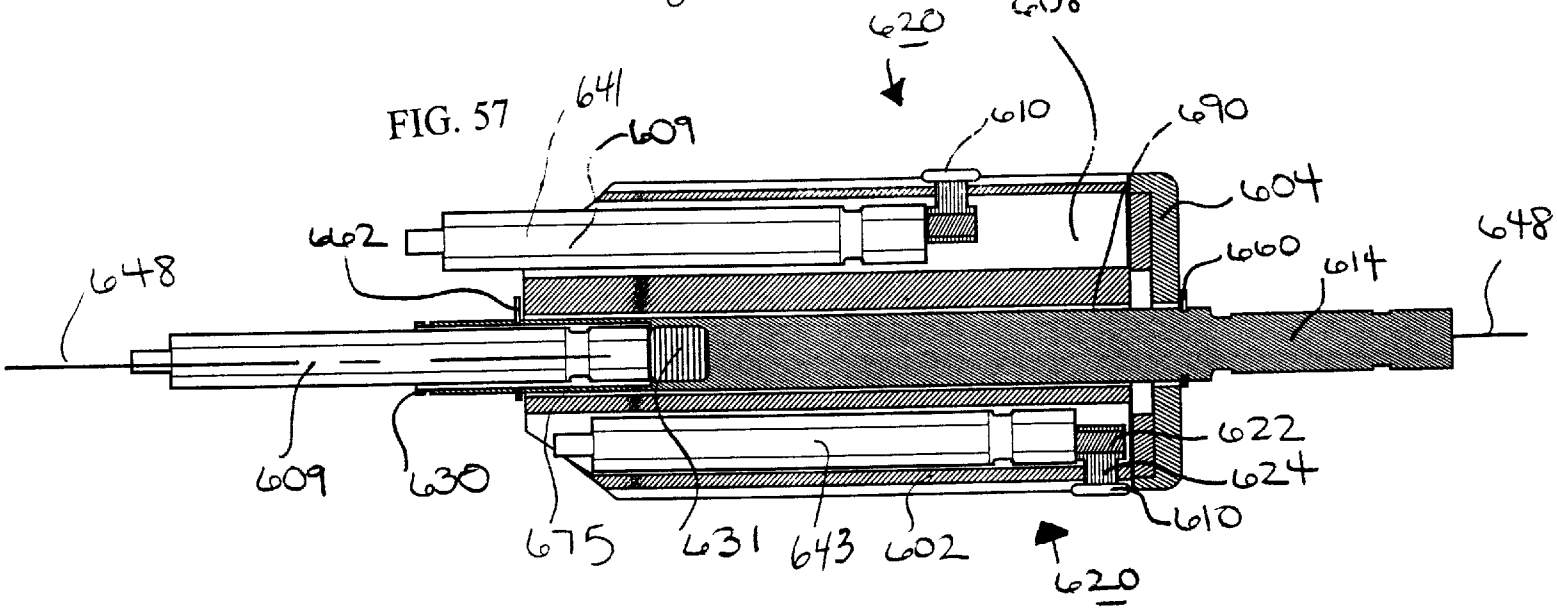
FIG. 57 is a cross-sectional schematic view of the bit holder taken along lines 9—9 of FIG. 56 of the bit holder shown in FIG. 50.

As shown in FIG. 55, the rearward portion of through shaft 64 can be releasably mounted into the jaws of a drill chuck as shown in FIG. 55 so that the rotation of the drill chuck imparts rotational forces onto through shaft 614.

FIG. 55 shows a hand 685 holding housing 602 of bit holder 600 preventing it from rotating with through shaft 614. In other words, through shaft 614 containing a bit 609 in socket 630 rotates freely and independently of housing 602 of bit holder 600, thereby allowing one to hold housing 602 in a hand 685 thereby steadying and directing the location of the bit 609 in socket 630. In addition, by preventing rotation of housing 602, any imbalance which may cause vibration due to rotational forces being imparted onto housing 602 can be avoided since housing 602 is maintained stationary. It is for example, foreseen that when one removes a bit 609 from a bit compartment 608, this will create a natural imbalance due to the differences in weight between one side and the other of housing 602, therefore if one does not maintain housing 602 stationary, significant vibration could occur due to the imbalances found in 602. This entire problem is avoided by simply maintaining housing 602 stationary with respect to rotating through shaft 614 as shown in FIG. 55.

Alternate Embodiment of the Bit Holder

An alternate embodiment of the bit holder is shown in FIGS. 58 through 66 inclusive showing generally a bit holder 700.

Bit holder 700 includes the following major components, namely housing 702 having defined therein a number of bit compartments 708 and including an end cap 704 retaining a washer 726 between said housing 702 and the end cap 704. Bit holder 700 further includes an actuator assembly 720 which includes a knob 710, a magnet holder 724, and a magnet 722.

Figure 63:
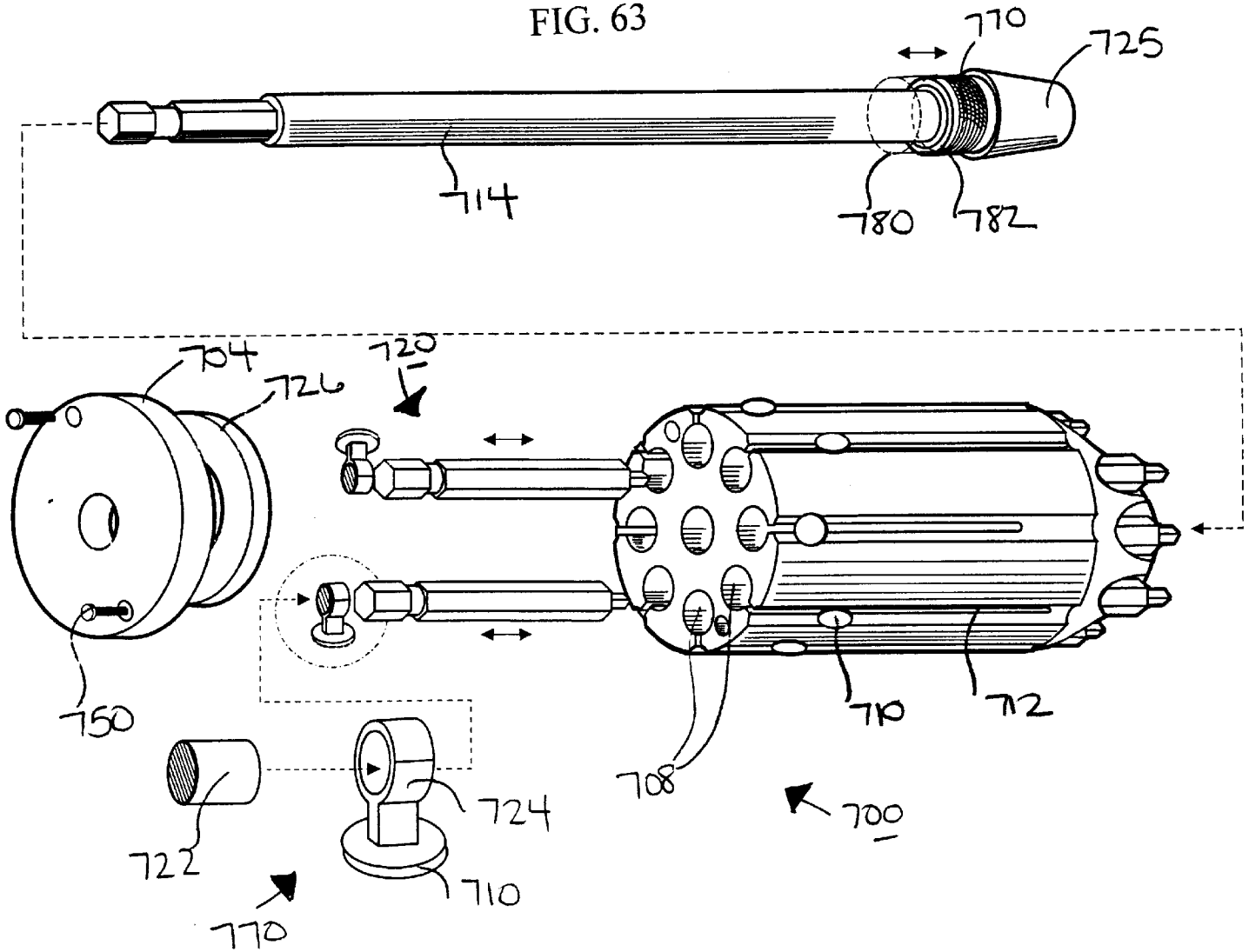
FIG. 63 is an exploded assembly schematic view of the bit holder shown in FIG. 59.

Referring now to FIG. 63 the exploded view of bit holder 700, through shaft 714 includes a socket housing 725 and a spring loaded sleeve 770 which can be moved into a unlocked position shown as 780 and a locked position shown as 782 in FIG. 63. This through shaft is commercially available as a complete unit and is marketed under the name LOCK-N-LOAD™ which is a commercially available shaft having a locking mechanism at one end and a hexagonal quarter inch standard hex shaft on the other end. The entire assembly including through shaft 714 is located symmetrical about longitudinal axis 799 and this bit holder functions in a similar manner as the above bit holder 600 with the following exceptions that the housing 702 is rigidly attached to through shaft 714 as was not the case in the bit holder 600 and as well the forward portion of through shaft 714 includes a locking mechanism for a quick mounting and dismounting of a bit 709 into socket 718.

In order to assemble bit holder 700, first of all actuator assembly 720 are slidably received within actuator channel 712 of housing 702 and thereafter a washer 726 is placed in the rearward portion of housing 702 and end cap 704 is rigidly mounted onto housing 702 using fastener 750. The entire housing 702 is interferingly
fit onto through shaft 714 and is dimensioned to interferingly fit also onto a portion of spring loaded sleeve 770 as best seen in the cross-sectional view in FIG. 66. In this manner when through shaft 714 rotates about longitudinal axis 799, so does housing 702 in unison with through shaft 714 which also rotates any bits 709 found in bit compartment 708.

Figures 58, 59, 60:
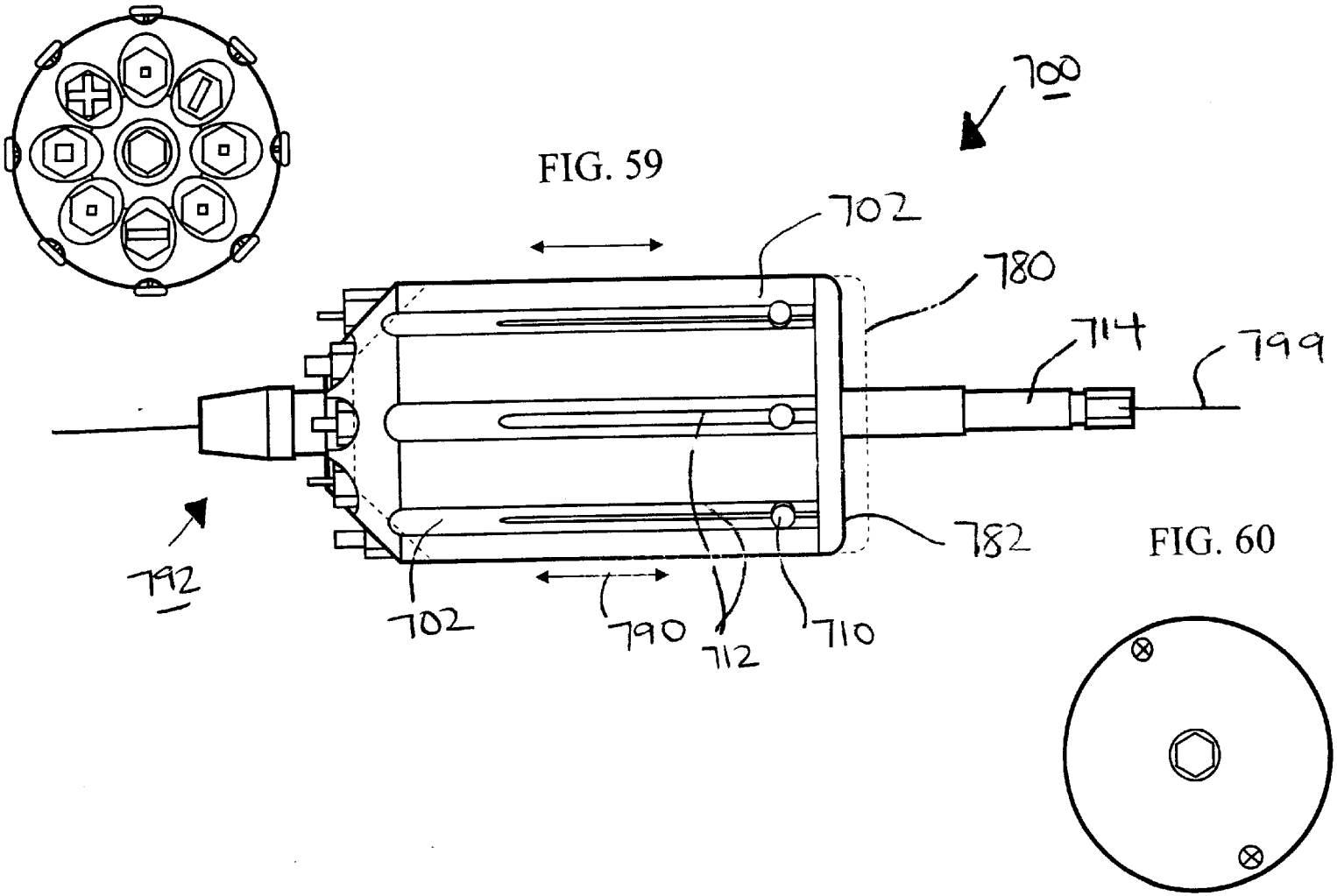
FIG. 58 is a plan view of the bit holder shown in FIG. 59.
FIG. 59 is a side elevational view of the bit holder of a new embodiment of the bit holder.
FIG. 60 is a rear elevational view of the bit holder shown in FIG. 69.
Figure 61:
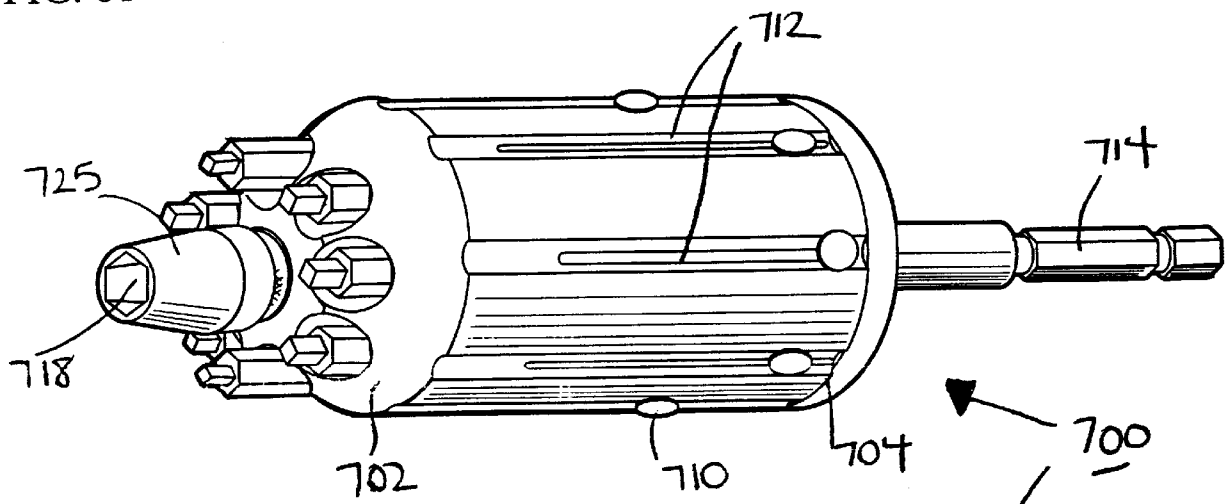
FIG. 61 is a front schematic perspective view of the bit holder shown in FIG. 59.
Figure 62:
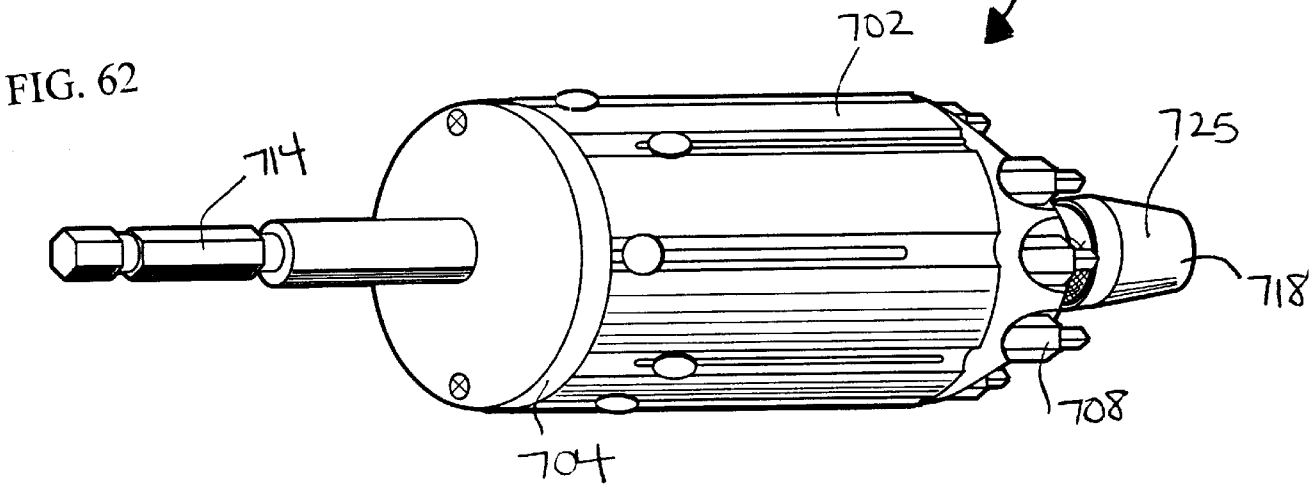
FIG. 62 is a rear perspective view of the bit holder shown in FIG. 59.

In order to remove a bit 709 from a bit compartment 708, knob 710 is urged forwardly along actuator channel 712 and once a bit 709 is projecting from a bit compartment 708 it can be grasped between the fingers and placed into socket 718 of locking mechanism 792 through shaft 714. In order to place the bit holder 700 into the unlocked position 780 as shown in FIG. 59 and also shown in FIG. 63, the entire housing 702 is urged backwardly into unlocked position 780 as shown in FIG. 59, thereby also urging spring loaded sleeve 770 backward into the unlocked position 780 such that a bit 709 will be received into socket 718 of locking mechanism 792 of through shaft 714.

Subsequently by releasing housing 702, the spring 749 found in locking mechanism 792 urges housing 702 into the locked position 782, thereby grasping the rearward portion of bit 709 and maintaining it within socket 718.

Figure 66:
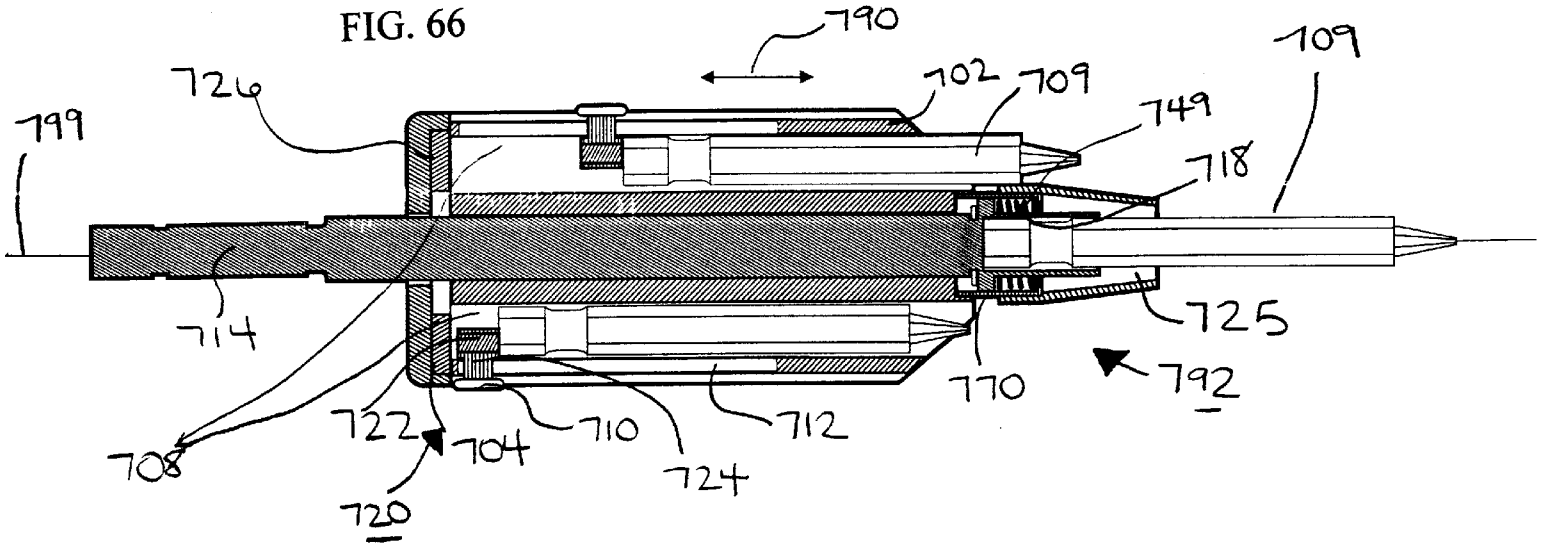
FIG. 66 is a cross-sectional view of the bit holder shown in FIG. 59 taken along lines 18—18 of FIG. 65.
Figures 67, 68, 69:
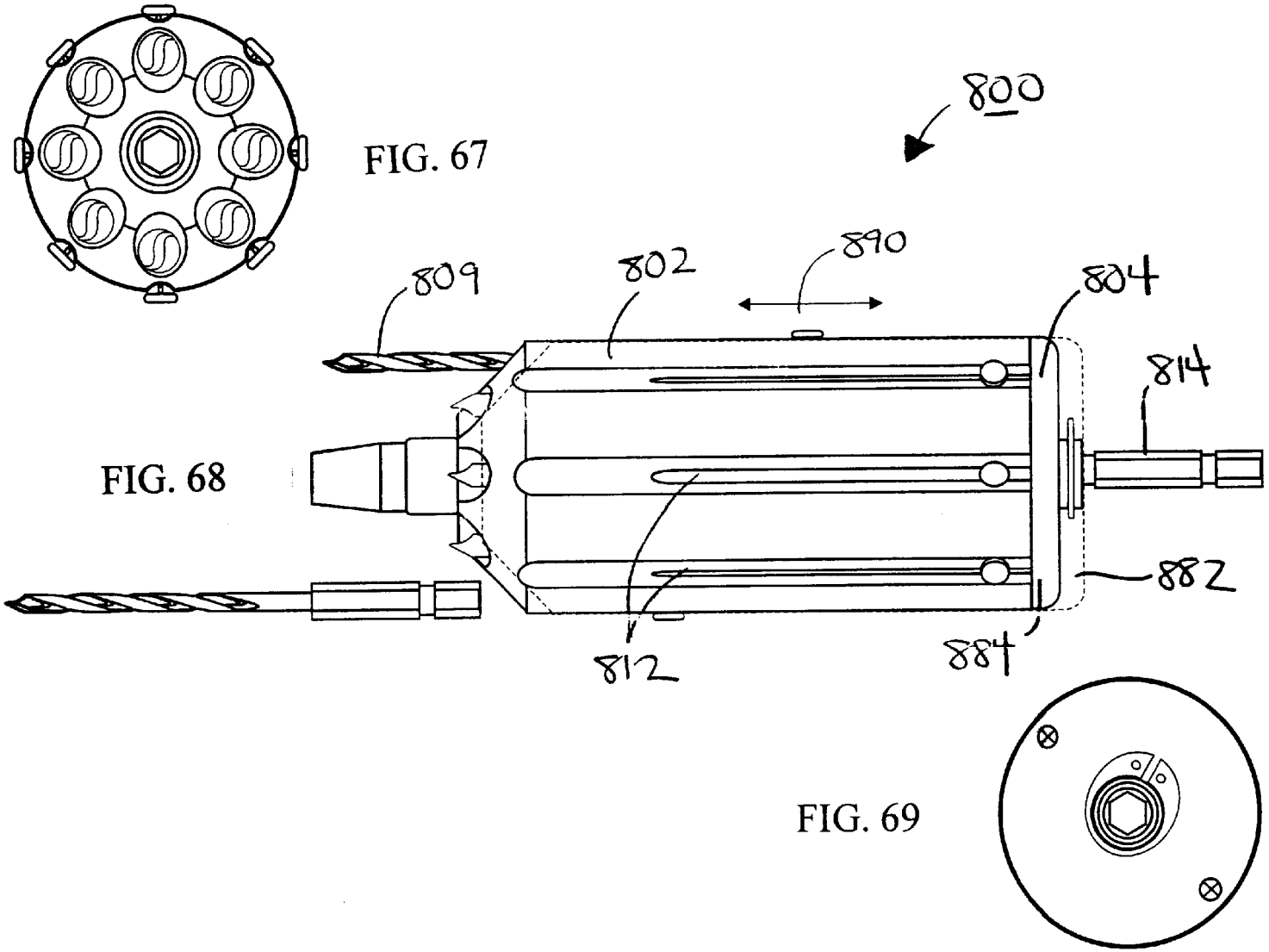
FIG. 67 is a front elevational view of the bit holder shown in FIG. 68, an alternate embodiment.
FIG. 68 is a side elevational view of the bit holder an alternate embodiment.
FIG. 69 is a rear elevational view of the bit holder shown in FIG. 68.
Figure 70:
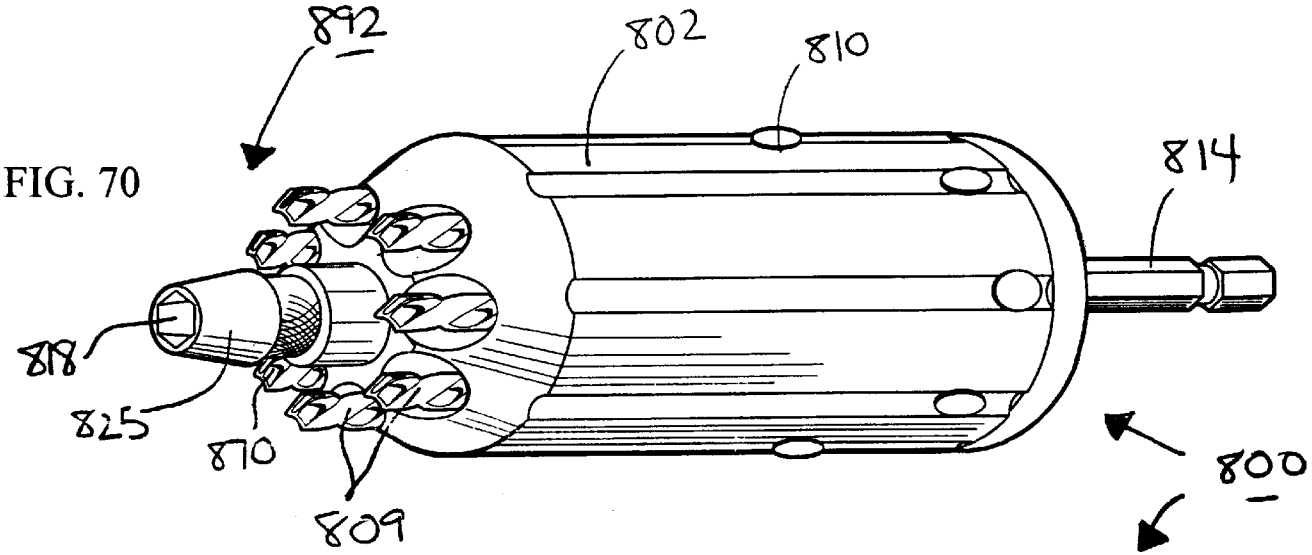
FIG. 70 is a front perspective view of the bit holder shown in FIG. 68.
Figure 71:
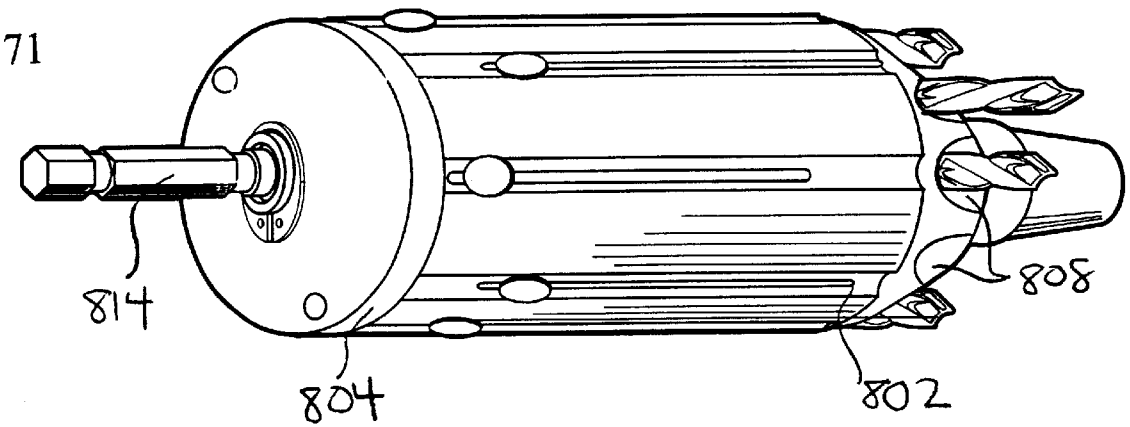
FIG. 71 is a rear schematic perspective view of the bit holder shown in FIG. 68.
Figure 72:
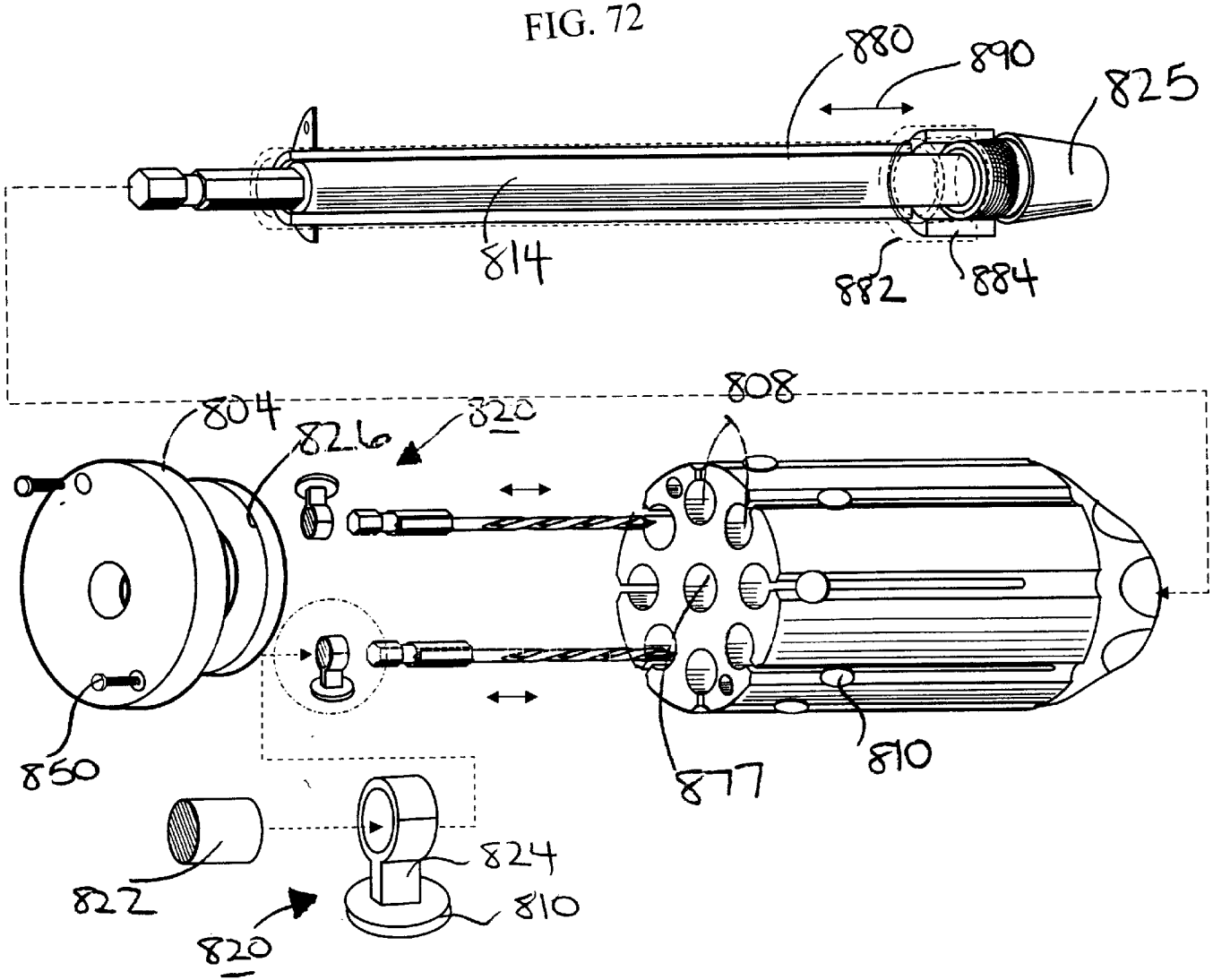
FIG. 72 is an exploded schematic assembly view of the bit holder shown in FIG. 68.
Figure 73:
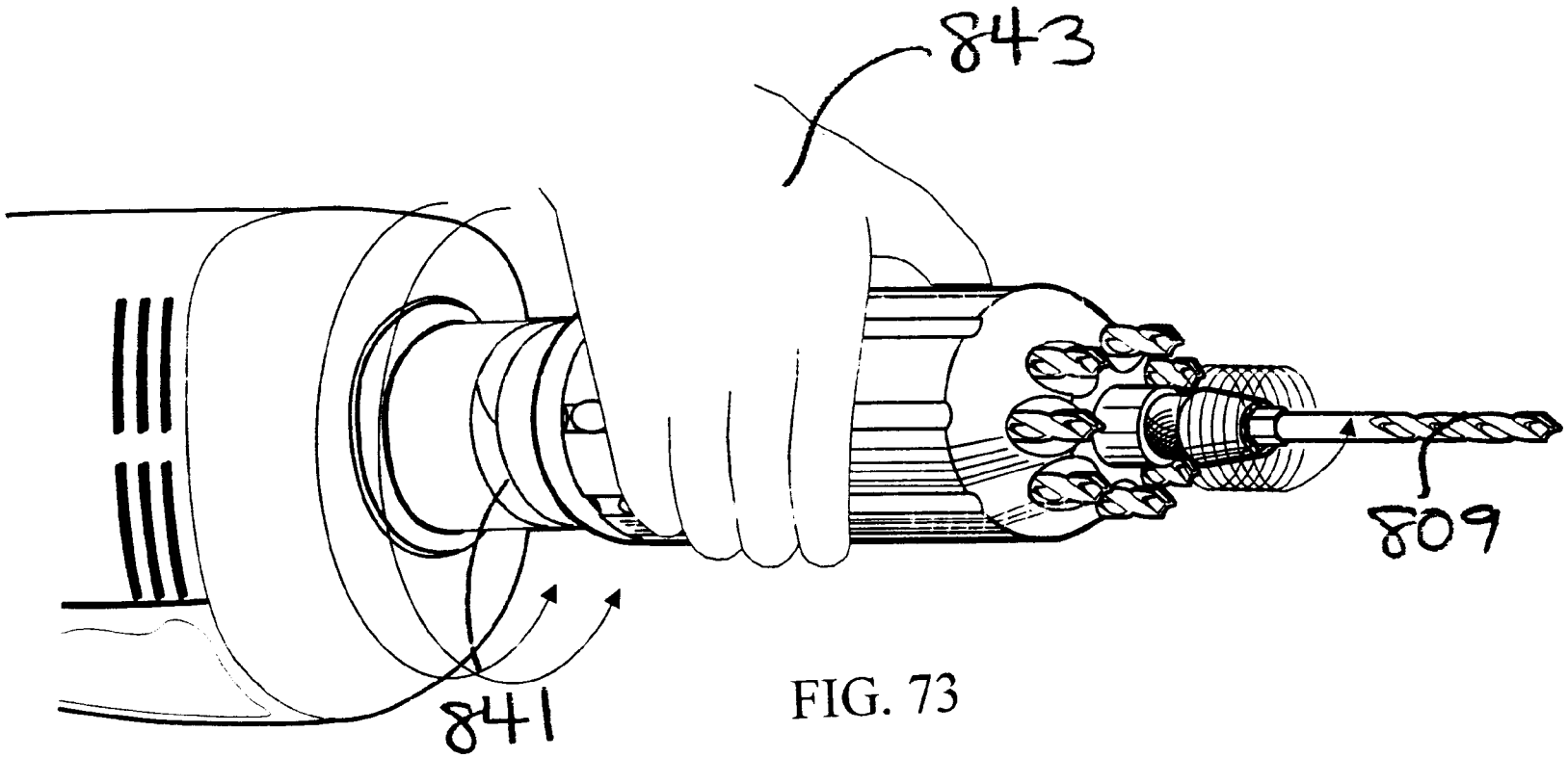
FIG. 73 shows bit holder mounted in drill chuck.
Figure 74:
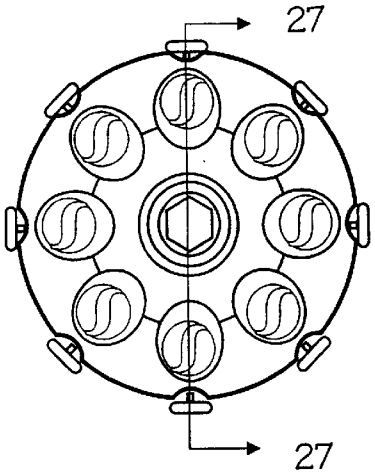
FIG. 74 is a front elevational view of the bit holder shown in FIG. 68.
Figure 75:
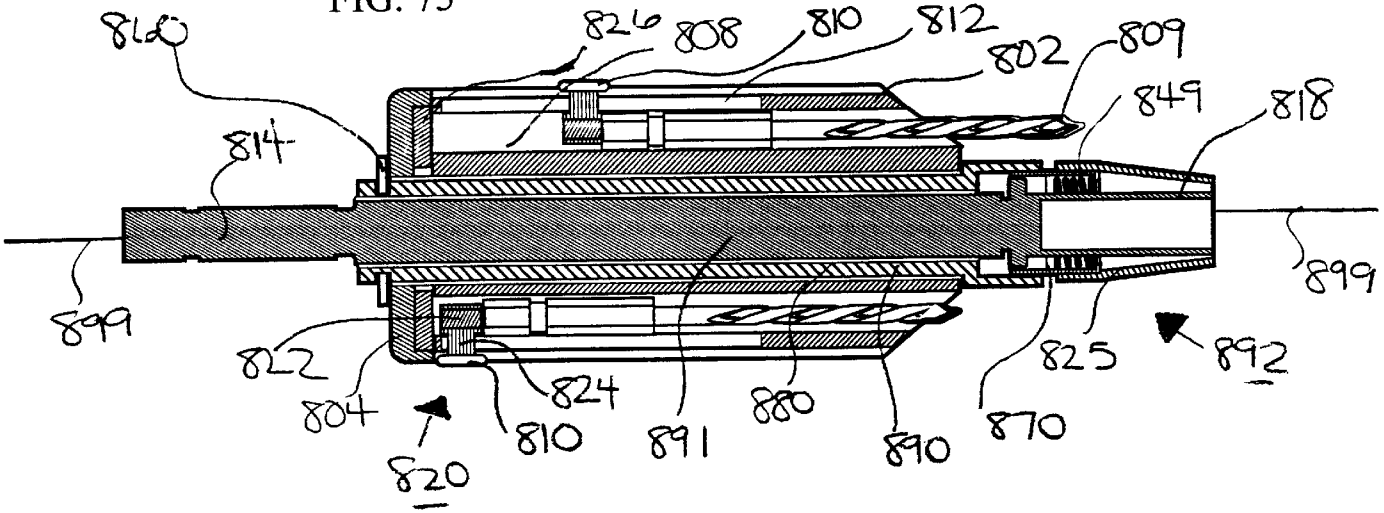
FIG. 75 is a cross-sectional schematic view of the bit holder shown in FIG. 68 taken along lines 27—27 of FIG. 74.

Therefore, by longitudinally urging housing 702 backwards and allowing it to longitudinally move forward, one can unlock and lock a bit 709 from socket 718. This locking motion 790 which is back and forth along the longitudinal axis 799 is shown in FIG. 66 as well as in FIG. 63 and FIG. 11.

Figure 64:
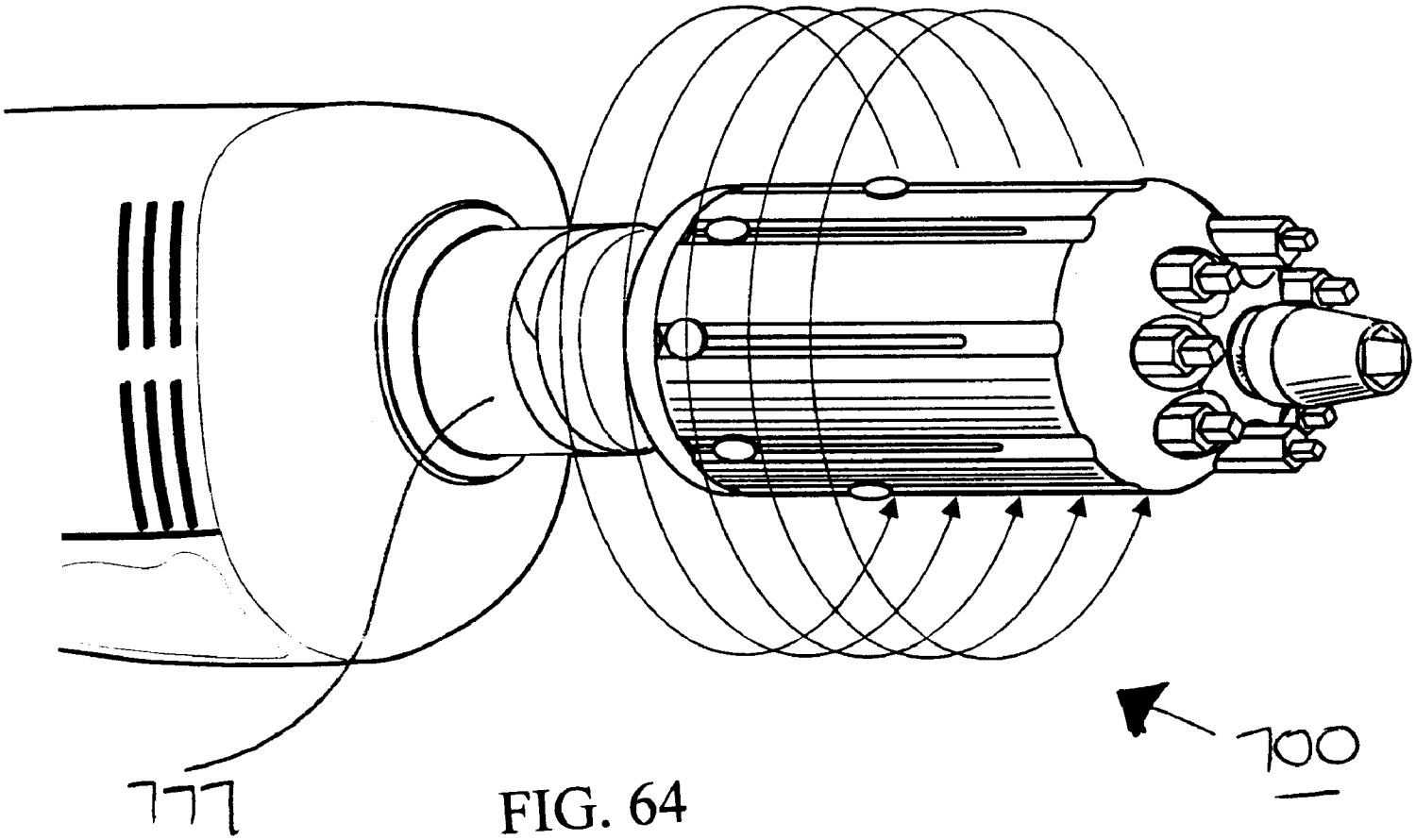
FIG. 64 is the bit holder shown in FIG. 59 mounted into a drill chuck.
Figure 65:
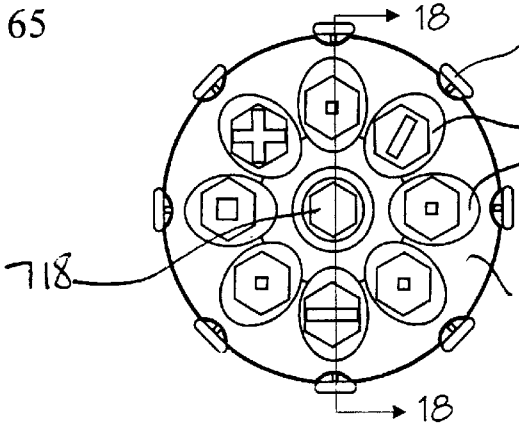
FIG. 65 is a front elevational view of the bit holder shown in FIG. 59.

Referring now to FIG. 64 when the tail hexagonal shank portion of through shaft 714 is rigidly mounted and clamped into a drill chuck as shown in FIG. 64, as the drill chuck is rotated, it inturn rotates through shaft 714 which in turn rotates the entire bit holder 700 unit including the housing 702. With bit holder 700 in the drill chuck 777, one simply urges the housing 702 backwards into the unlocked position 780 in order to either remove or add a tool bit 709 to the socket 718 of locking mechanism 792. This allows for a quick connect and disconnect of bits 709 from socket 718 and ensures that the bits 709 which are positioned in socket 718 are locked into position rather than just magnetically held in place as in the previous embodiment.

Alternate Embodiment of the Bit Holder

An alternate embodiment of the bit holder shown generally as 800 is depicted in FIGS. 67 through 75. Bit holder 800 includes features found in bit holder 600 as well as bit holder 700. Specifically bit holder 800 includes the feature of allowing body 802 to rotate independently of through shaft 814 and also provides the LOCK AND LOAD™ feature found in bit holder 700 by simply applying locking motion 890 to body 802.

Bit holder 800 includes the following major components, namely body 802, including a number of bit compartments 808, housing tool bits 809 and having a washer 826 mounted proximate the rear portion of body 802 and clamped into position with end cap 804 which is held in place with fasteners 850.

Bit holder 800 includes actuator assembly 820 having a knob 810, a magnet holder 824, and a magnet 822. It is slidably received within actuator channel 812 corresponding to each bit compartment 808.

Through shaft 814 which is mounted longitudinally along longitudinal axis 899, includes a locking mechanism 892 (similar to the previous one) having a socket 818 for receiving tool bits therein, spring loaded sleeve 870 with a spring 849 within a socket housing 825. As described above in a similar fashion by urging spring loaded sleeve 870 from the locked position 884 to the unlocked position 882, using the locking motion 890, one can toggle the locking mechanism 892 of through shaft 814 between the locked 884 and unlocked position 882 as described above.

Bit holder 800 also includes a bushing 880 which is concentrically situated between through shaft 814 and body 802. As best seen in cross-sectional view in FIG. 75, bushing 880 is dimensioned at one end to be interferingly pressed onto spring loaded sleeve 870 such that when urging bushing 880 backwards, one moves the spring loaded sleeve 870 from the locked position 884 to the unlocked position 892. Body 802 is slidably fit over the outer diameter of bushing 880 and is free to rotate about the longitudinal axis 899 such that the bearing surface lies between the outer diameter of bushing 880 and the inner diameter of body 802. In other words body 802, rotates about the outer diameter of bushing 880.

Bushing 880 is interferingly fit over the end of spring loaded sleeve 870, however slidably received onto the rearward portion of through shaft 814 such that bushing 880 can move slidably and longitudinally along bearing surface 891 back and forth along longitudinal axis 899 in order to affect locking motion 890. In other words the inner diameter of bushing 880 is slidably received along bearing surface 891 or the outer diameter of through shaft 814, however is interferingly and rigidly mounted onto one end of spring loaded sleeve 870. Therefore, bushing 880 does not rotate about longitudinal axis 899 but simply moves longitudinally back and forth along locking motion 890 of bit holder 800.

In order to assemble the bit holder 800, firstly bushing 880 is pressed onto the outer diameter of spring loaded sleeve 870 where it is rigidly attached to spring loaded sleeve 870. The inner diameter of bushing 880 is free to move however along bearing surface 891 being the outer diameter of through shaft 814. Next body 802 of bit holder 800 is slidably received onto the outer diameter of bushing 880 allowing it to freely rotate about bushing and through shaft 814 about bearing surface 890. Body 802 is held longitudinally in place onto bushing 880 with a cir clip 860.

When bit holder 800 is mounted into a drill chuck 841, it can be held in a hand 843 and prevented from rotating in unison with through shaft 814. The rear end of through shaft 814 is received and rigidly clamped into drill chuck 841 wherein it rotates in unison with drill chuck 841. By holding in a hand 843, body 802 of bit holder 800 one can maintain body 802 stationary and guide bit 809 in whatever operation one is carrying out. In addition by pulling rearwardly or urging backwardly, body 802 along locking motion 890, one can move housing 802 into the unlocked position 882 thereby releasing a bit 809 from socket 818. In the same fashion by moving body 802 from the locked position 884, to the unlocked position 882, one can replace a tool bit 809 in and out of socket 818 as one requires.

Bit holder 800 achieves the advantageous found in bit holder 600 as well as 700 in the that should there be any vacancy in any of the bit compartments 808 because of a missing bit 809, this imbalance will not be translated into a vibration since body 802 does not rotate in unison with through shaft 814. In addition, one can rigidly lock a bit 809 into the socket 818, simply by moving the housing 802 into the unlocked position 882 by urging it rearwardly using the locking motion 890.

It should be apparent to persons skilled in the arts that various modifications and adaptation of this structure described above are possible without departure from the spirit of the invention the scope of which defined in the appended claim.

I claim:

1. A drill attachment, for mounting into a drill chuck and for driving bits, said drill attachment comprising:

(a) a central longitudinal shaft means adapted at a rear end for releasably mounting into a drill chuck, and a front end adapted for releasably mounting tool bits projecting forwardly from said front end and for rotatably driving said tool bits;

(b) a housing mounted onto said shaft means such that said shaft means rear end projecting rearwardly from said housing for mounting into a drill chuck, and said shaft means front end projecting forwardly from said housing; and (c) wherein said housing adapted for releasably storing multiple tool bits in longitudinally oriented bit compartments defined in said housing, said bit compartment spaced from and nested around said central shaft means such that said bits are securely held in place upon rotation of said drill attachment by a drill;

(d) wherein said drill attachment including an actuating means for operatively magnetically retaining bits in said bit compartments and for operatively selectively sliding a bit along a bit compartment between an extended and retracted position.

2. The drill attachment claimed in claim 1, wherein said actuating means including a magnet retained in a magnet holder, said magnet holder sized and adapted for slideably moving along a bit compartment.

3. The drill attachment claimed in claim 2, wherein said housing including longitudinally oriented actuator channels corresponding and communicating with each bit compartment, said actuator channels adapted for slideably receiving a portion of the said magnet holder extending through said actuator channel.

4. The drill attachment claimed in claim 3 wherein the portion of said magnet holder extending through said actuator channel connected at one end to a knob and at the other end to a magnet, said portion for guiding said magnet holder longitudinally along said actuator channel.

5. The drill attachment claimed in claim 4 wherein the knob projecting externally of said housing adapted for applying finger pressure thereon for operatively slidably moving said magnet with said magnet holder along said bit compartment and thereby slidably urging said bit magnetically connected to said magnet along said bit compartment.

6. The drill attachment claimed in claim 1 wherein said shaft means rotates in unison with said drill chuck, and said housing is slidably received on said shaft means thereby rotating independently on said shaft means such that said housing can be held stationary as said shaft means rotates.

* * * * *